US007905672B2

(12) United States Patent
Busam et al.

(10) Patent No.: US 7,905,672 B2
(45) Date of Patent: Mar. 15, 2011

(54) INSERTABLE DIVIDERS FOR A BOUND COMPONENT

(75) Inventors: Edward P. Busam, Mason, OH (US); Diana W. Juratovac, Columbus, OH (US)

(73) Assignee: MeadWestvaco Corporation, Richmond, VA (US)

( * ) Notice: Subject to any disclaimer, the term of this patent is extended or adjusted under 35 U.S.C. 154(b) by 1214 days.

(21) Appl. No.: 11/293,994

(22) Filed: Dec. 5, 2005

(65) Prior Publication Data

US 2006/0216108 A1 Sep. 28, 2006

(51) Int. Cl.
*B43K 29/00* (2006.01)

(52) U.S. Cl. ..... 401/195; 402/73; 402/79

(58) Field of Classification Search ..... 401/17, 401/18, 21, 23, 25, 34, 73, 195, 198, 199; 402/70, 71, 73, 79, 502, 80 P; 281/31, 36, 281/37, 39, 42; 283/40; 206/232, 425
See application file for complete search history.

(56) References Cited

U.S. PATENT DOCUMENTS

| | | | |
|---|---|---|---|
| 665,650 | A | 1/1901 | Clymer |
| 1,316,039 | A | 9/1919 | James |
| 1,682,192 | A | 8/1928 | Schoolberg |
| 1,741,066 | A | 12/1929 | Morgan |
| 2,696,992 | A | 12/1954 | Duff |
| 2,713,342 | A | 7/1955 | Landes |
| 3,025,834 | A | 3/1962 | Aaron |
| 3,077,184 | A | 2/1963 | Vogel |
| D220,296 | S | 3/1971 | Berlin |
| 3,684,389 | A | 8/1972 | Eron et al. |
| 3,719,161 | A | 3/1973 | Wegner |
| 3,828,696 | A | 8/1974 | Lockridge |
| 3,941,488 | A | 3/1976 | Maxwell |
| 3,985,455 | A | 10/1976 | Wahlberg |
| 4,213,717 | A | 7/1980 | Lin |
| 4,221,490 | A | 9/1980 | Malm |
| 4,357,431 | A | 11/1982 | Murakami et al. |
| 4,430,015 | A | 2/1984 | Nerlinger |
| 4,441,270 | A | 4/1984 | Crowell et al. |
| 4,509,875 | A | 4/1985 | Shintani |
| D279,992 | S | 8/1985 | Gribb |
| 4,549,827 | A | 10/1985 | Mack |
| 4,557,618 | A | 12/1985 | Iwata et al. |
| 4,600,327 | A | 7/1986 | Guzman |
| 4,636,179 | A | 1/1987 | Gentile et al. |
| D295,878 | S | 5/1988 | Lovell |
| 4,744,689 | A | 5/1988 | Sternberg |
| 4,849,056 | A | 7/1989 | Ristuccia, Sr. |
| D303,683 | S | 9/1989 | Brock |
| 4,865,479 | A | 9/1989 | Doll |
| D306,316 | S | 2/1990 | Shintani |
| D306,873 | S | 3/1990 | Yazaki |
| D307,602 | S | 5/1990 | Lee |
| 4,979,840 | A | 12/1990 | Madaus et al. |
| 5,033,895 | A | 7/1991 | Aida |
| 5,033,899 | A | 7/1991 | Pitts et al. |

(Continued)

*Primary Examiner* — Tuan N Nguyen
(74) *Attorney, Agent, or Firm* — MWV Intellectual Property Group

(57) ABSTRACT

A system including a bound component comprising a plurality of sheets of paper and a binding mechanism binding the plurality of sheets of paper together. The system further includes a divider configured to be directly releasably coupled to the binding mechanism such that the divider can be positioned between adjacent ones of the sheets of paper. The divider is made of a polymer material. The system further includes a permanent writing instrument configured to dispense permanent markings on the divider when the divider is written upon by the writing instrument. The system further includes an erasing means for erasing permanent markings from the divider.

34 Claims, 22 Drawing Sheets

U.S. PATENT DOCUMENTS 5,044,807 A 9/1991 Meservy et al.
5,072,483 A 12/1991 Durand
5,114,259 A 5/1992 Meservy et al.
5,118,213 A 6/1992 Meservy et al.
5,123,191 A 6/1992 Kim
5,123,766 A 6/1992 Babiak
5,131,776 A 7/1992 Mott
D330,388 S 10/1992 Choi
5,169,255 A 12/1992 Jensen
D336,425 S 6/1993 Napora, Jr.
5,294,208 A 3/1994 Tremmel
5,338,123 A 8/1994 Obersteller et al.
5,427,278 A 6/1995 Gardner, III
5,432,973 A 7/1995 Wagner et al.
5,476,336 A 12/1995 Osiecki et al.
5,489,331 A 2/1996 Miller et al.
5,492,558 A 2/1996 Miller et al.
5,578,117 A 11/1996 Matz et al.
5,649,999 A 7/1997 Wang
5,669,726 A 9/1997 Karlis et al.
5,678,943 A 10/1997 Parsons
5,702,513 A 12/1997 Causton et al.
5,727,894 A 3/1998 Covey
D393,483 S 4/1998 Covey
D404,069 S 1/1999 Hasegawa
D404,424 S 1/1999 Covey
5,855,442 A 1/1999 Keller
5,871,294 A 2/1999 Turner
5,876,145 A 3/1999 Datum
5,895,160 A 4/1999 Ginelli
5,897,265 A 4/1999 Wilson
5,909,979 A 6/1999 Winzen
5,915,873 A 6/1999 Karlis
5,957,700 A 9/1999 Ariyama
6,000,873 A 12/1999 Burton
6,004,057 A 12/1999 Fulop
6,012,866 A 1/2000 Podosek
6,019,535 A 2/2000 Turner
6,031,023 A 2/2000 Carroll et al.
D422,018 S 3/2000 Brown et al.
D423,046 S 4/2000 Jordin et al.
6,045,161 A 4/2000 Ashcraft et al.
6,048,121 A 4/2000 Carver
6,086,281 A 7/2000 Covey
6,089,607 A 7/2000 Keeney et al.
6,095,707 A 8/2000 Kaufmann
6,135,662 A 10/2000 Bakke et al.
6,179,501 B1 1/2001 Fulop
6,183,155 B1 2/2001 Kaufmann
6,183,157 B1 2/2001 Brown et al.
6,200,056 B1 3/2001 Jordin et al.
6,209,778 B1 4/2001 Henrikson et al.
6,250,006 B1 6/2001 Berrier
D445,130 S 7/2001 Ginelli
6,289,615 B1 9/2001 Kytlica
D451,139 S 11/2001 Wang
D451,273 S 12/2001 Moor et al.
6,344,498 B1 2/2002 Allison et al.
6,347,898 B1 2/2002 Rhodes et al.
6,361,639 B1 3/2002 Owen et al.
6,371,680 B1 * 4/2002 Webb ..... 402/79
6,379,001 B1 4/2002 Tomida et al.
6,382,864 B1 5/2002 Moor
6,390,713 B1 5/2002 Moor et al.
6,413,001 B1 7/2002 Kaufmann
6,435,747 B2 8/2002 Furukawa et al.
D462,715 S 9/2002 Moor et al.
6,491,464 B1 12/2002 Young
6,497,527 B2 12/2002 Kaufmann
6,505,984 B2 1/2003 Smith et al.
D471,586 S 3/2003 Geiselhart et al.
6,543,379 B2 4/2003 Schwartz
6,565,275 B2 5/2003 Brand et al.
6,572,302 B2 6/2003 Gogoana
6,607,216 B1 8/2003 Stenger et al.
6,626,601 B1 9/2003 Moor et al.
6,672,785 B1 1/2004 O'Hara et al.
6,729,790 B1 5/2004 Moor et al.
6,769,829 B1 8/2004 Castillo et al.
6,877,262 B2 4/2005 Bianco
6,902,340 B2 6/2005 Harris, Jr. et al.
6,932,531 B2 8/2005 Marschand
6,974,274 B2 * 12/2005 Sapienza et al. ..... 402/79
2001/0012468 A1 8/2001 Furukawa et al.
2001/0016141 A1 8/2001 Kaufmann
2001/0033767 A1 10/2001 Howes
2002/0159817 A1 10/2002 Brand et al.
2003/0155761 A1 8/2003 Stenger et al.
2003/0157472 A1 8/2003 Castillo et al.
2004/0136774 A1 * 7/2004 O'Boyle ..... 402/73
2004/0213627 A1 10/2004 Marschand et al.
2005/0147956 A1 7/2005 Widman et al.
2005/0150423 A1 7/2005 Godbout
2005/0158113 A1 7/2005 Wehmeyer
2005/0175390 A1 8/2005 Wehmeyer
2005/0180810 A1 8/2005 Wong et al.
2006/0285914 A1 12/2006 Bassford

* cited by examiner

INSERTABLE DIVIDERS FOR A BOUND COMPONENT

The present invention is directed to insertable dividers for a bound component, and more particularly, to insertable dividers which can be written upon and/or protrude outwardly from the pages of the bound component.

BACKGROUND

When utilizing a bound component, such as a notebook, binder, address book, planner, diary, journal and the like, it is often desired to mark a location in the bound component for future reference. Bookmarks are commonly used for such a purpose. However, bookmarks are often prone to fall out of the bound component and thus can become easily lost or displaced. Thus, there is a need for a place-marking device which can be securely coupled to the bound component.

In addition, there is a need for a place-marking device which can be repeatedly written upon. Such a place-marking device would allow a user to customize the place-marking device and reuse the place-marking device as desired.

SUMMARY

In one embodiment, the present invention is a divider which can be releasably yet securely coupled to a bound component. In another aspect of the invention, the divider can be marked upon with markings that can be erased to allow reuse of the divider. In another aspect, the divider is configured to protrude outwardly from the bound component to provide a readily identified divider.

In one embodiment, the invention is a system including a bound component comprising a plurality of sheets of paper and a binding mechanism binding the plurality of sheets of paper together. The system further includes a polymer divider configured to be directly releasably coupled to the binding mechanism such that the divider can be positioned between adjacent ones of the sheets of paper. The system further includes a permanent writing instrument configured to dispense permanent markings on the divider when the divider is written upon by the writing instrument. The system further includes an erasing means for erasing permanent markings from the divider.

In another embodiment the invention is a bound component system including a plurality of sheets of paper and a binding mechanism binding the plurality of sheets of paper together. The plurality of sheets of paper have a width dimension extending generally perpendicular to the binding mechanism. The system further includes a divider configured to be directly releasably coupled to the binding mechanism such that the divider can be positioned between adjacent ones of the sheets, wherein the divider has a width greater than the width of the plurality of sheets of paper.

DETAILED DESCRIPTION

Figure 1:
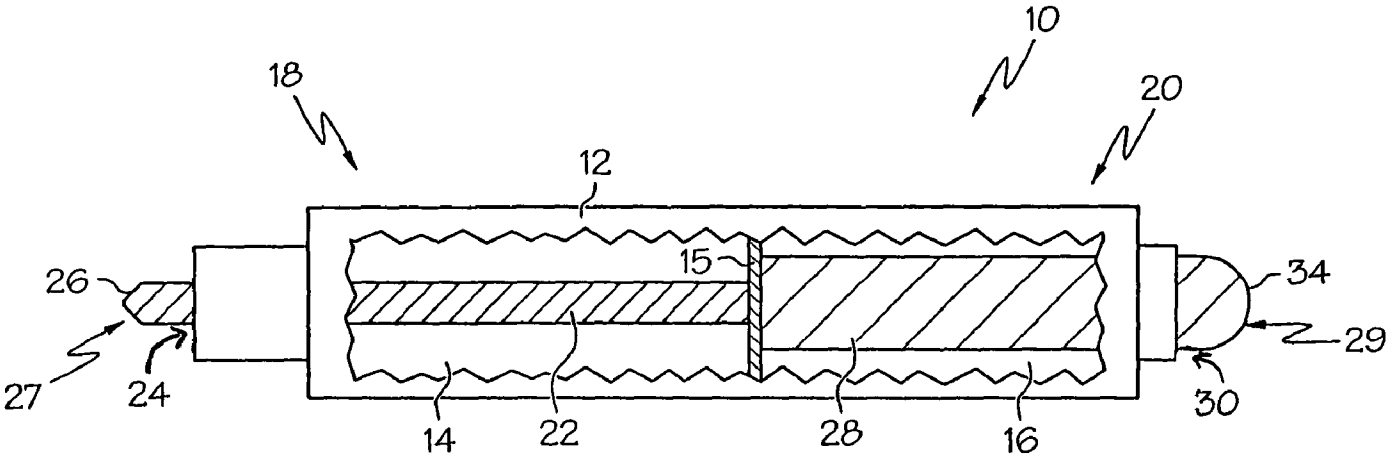
FIG. 1 is a front view of a marker with a portion of the marker body cut away.

With reference to FIG. 1, a marker or writing instrument 10 is shown and includes a writing instrument body or marker body 12. The marker body 12 may be generally tubular or cylindrical and may have a first portion 18 and a second portion 20. The marker body 12 may include a first reservoir 14 located generally inside of the first portion 18 and a second reservoir 16 located generally inside of the second portion 20, with the first 14 and second 16 reservoirs separated by a divider 15. The maker body 12 may include a first opening 24 that is located at an end of the marker body 12 and in communication with the first reservoir 14. The marker body 12 may also include a second opening 30 that is located at the other of the marker body 12 and in communication with the second reservoir 16.

The marker body 12 includes a first wick 22 generally closely received in and through the first opening 24 and extending into the first reservoir 14. The first wick 22 has an exposed portion 27 extending out of the first reservoir 14, with the exposed portion 27 having or forming a writing tip 26. The marker body 12 includes a second wick 28 generally closely received in and through the second opening 30 and extending into the second reservoir 16. The second wick 28 has an exposed portion 29 extending out of the second reservoir 16, with the exposed portion 29 including or forming an erasing tip 34. The wicks 22, 28 may be made from a wide variety of materials, such as felt. Although the marker 10 is illustrated as having a tip 26, 34 at each end, the marker 10 may have a wide variety of other configurations for the tips 26, 34 and/or wicks 22, 28, including having the tips 26, 34, being oriented at various angles, being located in a side-by-side configuration, having only a single tip, etc.

The first reservoir 14 may be filled with a permanent or indelible ink solution of any of a wide variety of colors. The permanent ink or permanent ink solution in the first reservoir 14 may be nearly any type of permanent ink or ink solution, such as a traditional organic solvent based permanent ink with a wide variety of pigments, dye, colorants or the like, or an aqueous type permanent ink as described in U.S. Pat. No. 5,131,776, the entire contents of which are hereby incorporated by reference. The permanent ink may be an alcohol (i.e. n-propyl alcohol) based or other organic solvent based permanent ink. The permanent ink may be capable of marking on porous surfaces (e.g., paper, wood and the like) and nonporous surfaces (e.g., glass, metal, plastic and other polymer based surfaces). Further, the permanent ink may be resistent to smearing and re-wetting after application and may resist emulsification, dissolving or removal with soap and water.

The second reservoir 16 may be filled with a solvent that can dissolve the permanent ink or ink solution in the first reservoir 14. The solvent in the second reservoir 16 may be any solvent that is capable of solubilizing or dissolving permanent ink or a permanent ink solution that has been applied to a surface and allowed to dry. The solvent may be or include an ethyl alcohol, an n-propyl alcohol, or other organic based solvents.

For example, the solvent may be a dry-erase solution typically used in a dry-erase marker. Thus the solvent may also optionally include a colorant, dye or pigment and a binder resin such that the second portion 20 can operate as a dry-erase marker. In this case, when the dry-erase solution is applied to a polymeric or plastic type surface, the solvent evaporates and the binder resin and colorant remain behind as a friable discontinuous film.

The permanent ink solution in the first reservoir 14 may be soaked through the first wick 22, or permanent ink dispensing wick 22, and wicked through the permanent ink dispensing wick 22 until the permanent ink solution reaches the writing tip 26. In this manner, when the writing tip 26 contacts a substrate to be written upon, ink from the first reservoir 14 is deposited on the substrate. Similarly, the solvent in the second reservoir 16 soaks the second wick 28, or solvent dispensing wick 28, such that the solvent is wicked through the solvent dispensing wick 28 until it reaches the erasing tip 34. When the erasing tip 34 contacts the substrate, solvent from the second reservoir 16 is deposited onto the substrate and solubilizes (or dissolves) any ink deposited by the permanent ink dispending wick contacted by the solvent. Thus the marker 10 may be a double-ended felt-tip marker, although the marker 10 may include various other manners of dispensing the permanent ink and solvent, such as ball-point dispensers, gel-type dispensers, etc.

Figure 2:
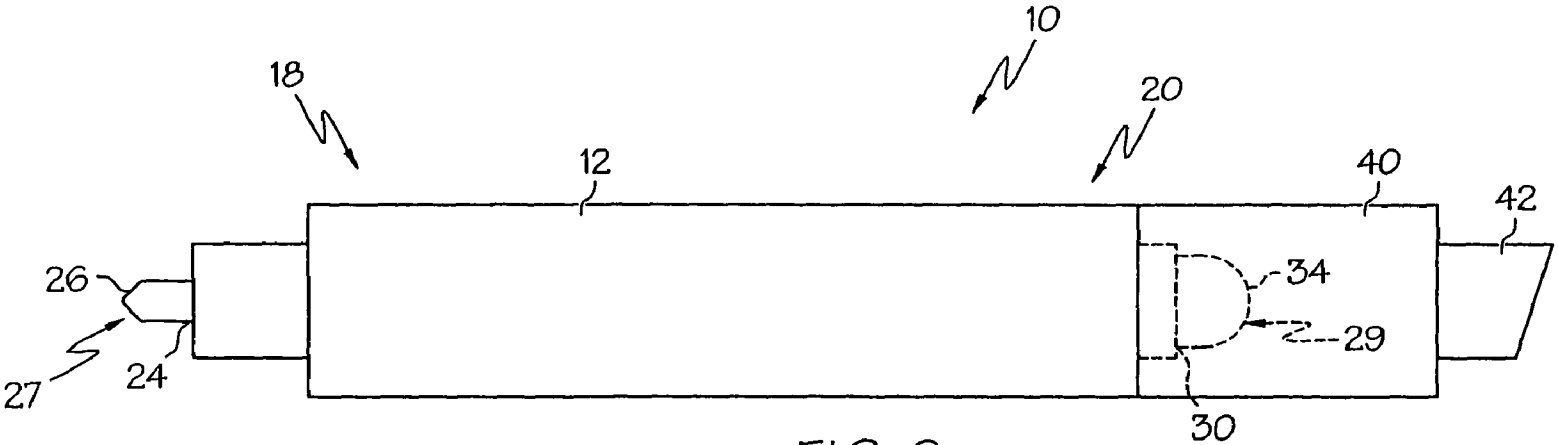
FIG. 2 is a front view of the marker of FIG. 1 including a cap mounted thereon.

The marker 10 may include a cap 40 for covering either the erasing tip 34 (as shown in FIG. 2) or, alternatively or in addition, the writing tip 26. The cap 40 prevents the ink and solvent from evaporating through the wicks 22, 28 when the marker 10 is not in use. For example, as shown in FIG. 2, the cap 40 may include a body portion shaped to form a tight interference fit or seal with the marker body 12 to seal off the associated tip 26, 34. The cap 40 may also include an absorbent portion 42 located, for example, on an outer surface, or outer end surface, of the cap 40. The absorbent portion 42 may be made of a felt, cotton, foam, sponge-type material or other absorbent material. The absorbent portion 42 may be used to wipe away markings that are deposited by the writing tip 26 and erased/dissolved by the erasing tip 34. If desired, the marker 10 may include two caps 40, with each cap 40 located on each end of the marker 10, and at least one cap 40 may include an absorbent portion 42, although both caps 40 may include an absorbent portion 42.

Figure 3:
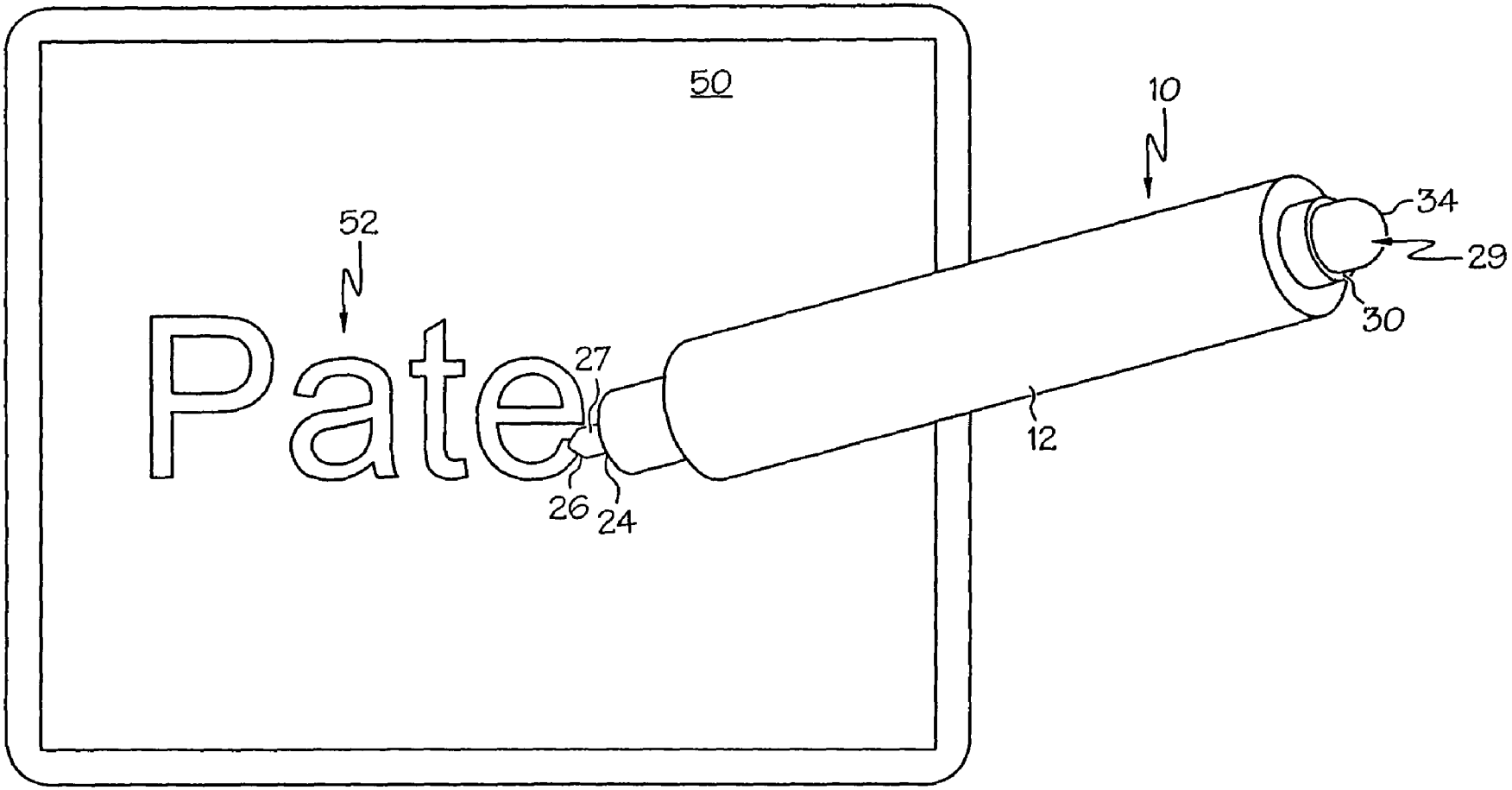
FIG. 3 is a front view of a writing surface being marked upon by the marker of FIG. 1.

As shown in FIG. 3, a user may mark various indicia or markings 52 on a writing surface 50 using the writing tip 26 of the marker 10. The markings 52 may then be allowed to dry. Once dry, the markings 52 may not be able to be erased by simply rubbing the markings by hand, or with soap and water or the like. The permanent markings 52 may then be allowed to remain in place for as long as desired. Once it is desired to erase the markings 52, the erasing tip 34 is applied to the markings 52 to solubilize/erase/dissolve the markings 52. The erasing tip 34 may be moved over the markings 52 such that the solvent contacts the deposited markings 52 and solubilizes the markings 52, thereby allowing the markings 52 to be erased. A user may then take the cap 40 and apply the absorbent portion 42 to the writing surface 50 to wipe away or absorb the solubilized markings.

The writing surface 50 may be made of a typical plastic material such as polypropylene, polyethylene or the like that is capable of being marked upon using permanent ink, but not with typical water based inks. The writing surface 50 may have a glossy finish surface and/or a UV aqueous coating and/or other coatings. The writing surface may be made of a material that is chemically resistant to any solvents dispensed by the writing instrument (i.e., erasing solutions located in the second reservoir 16).

Further, the writing surface 50 may have a surface roughness sufficient to absorb or receive ink in the creases and recesses, but not exceedingly rough to make it overly difficult to remove the ink. In one embodiment, the writing surface 50 has an average surface roughness of between about 50-1000 microns, or more particularly between about 9-100 microns. The writing surface 50, permanent ink and solvent should be selected such that application of the permanent ink or solvent to the writing surface 50 does not significantly alter, destroy or marr the writing surface 50. Proper selection may allow the writing surface 50 to be used many times over for marking and erasing.

Figure 4:
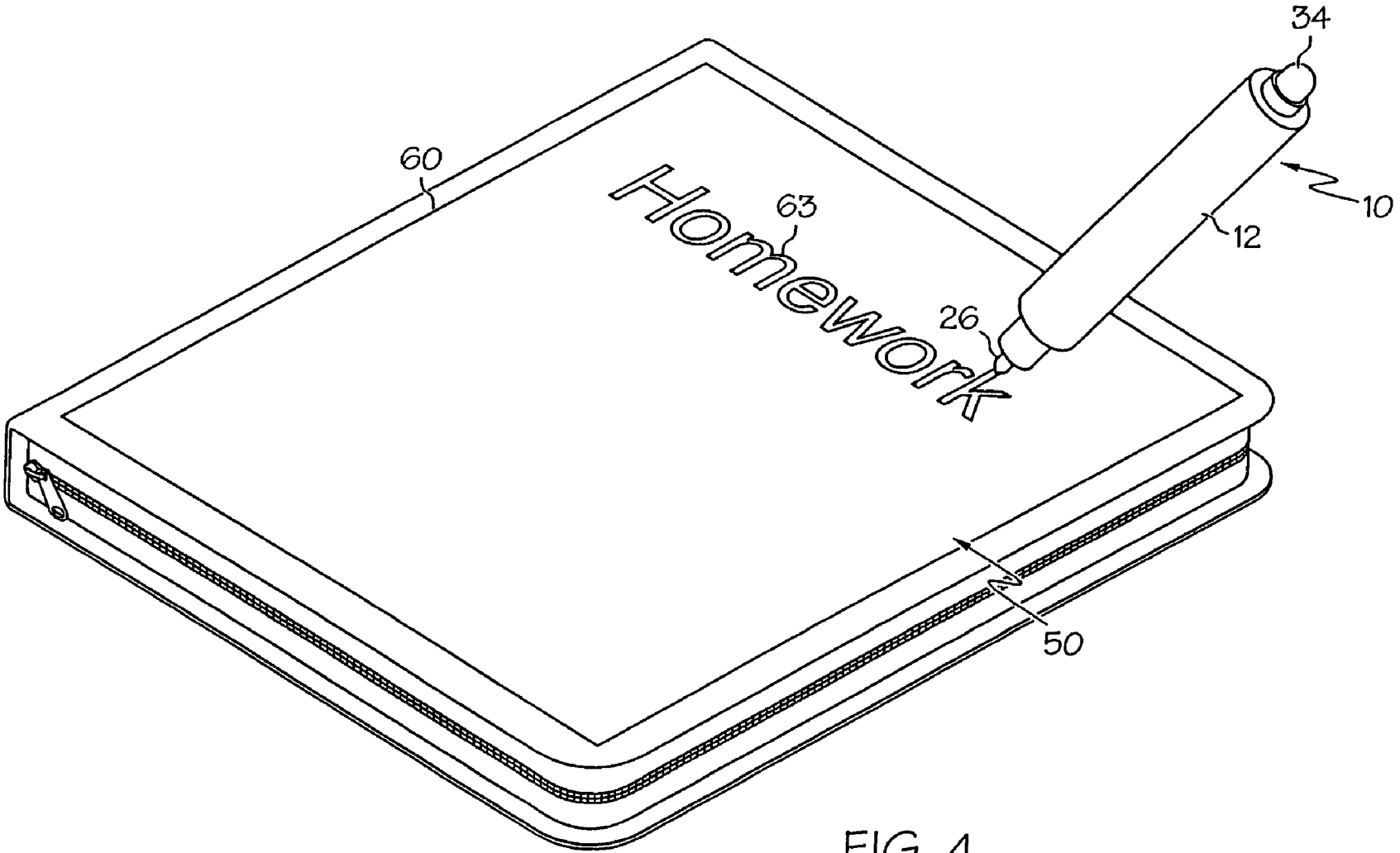
FIG. 4 is a front perspective view of a binder including a writing surface and being marked upon by the marker of FIG. 1.

The writing surface 50 may be, include, or be part of various devices or products. For example, the writing surface 50 may be formed as part of a school or office product such as a binder 60 (FIG. 4), 70 (FIGS. 5 and 6) or 80 (FIGS. 7 and 8), a notebook 90 (FIGS. 9 and 10), a folder 100 (FIG. 11), a book cover 110 (FIGS. 12 and 13), as well as a divider, portfolio, tablet, note pad, clipboard, briefcase, storage case, compact disk case, compact disk, computer case, electronic device case or the like for home, school, business, office or other use. Thus, for example, in school use, a user may write certain notes or reminders (i.e. a reminder of a homework assignment) on the outer surface of a binder 60, 70, 80 which includes the writing surface 50. The writing 63 on the binder 60 (see FIG. 4) may be written in permanent ink and therefore resists smudging and accidental erasure, even when exposed to water and most common liquids. When the user desires to remove the marking 63 (i.e. when the homework project is complete or when a new homework assignment is received) the user can remove the markings 63 using the erasing tip 34 and absorbent portion 42 of the cap 40.

Figure 5:
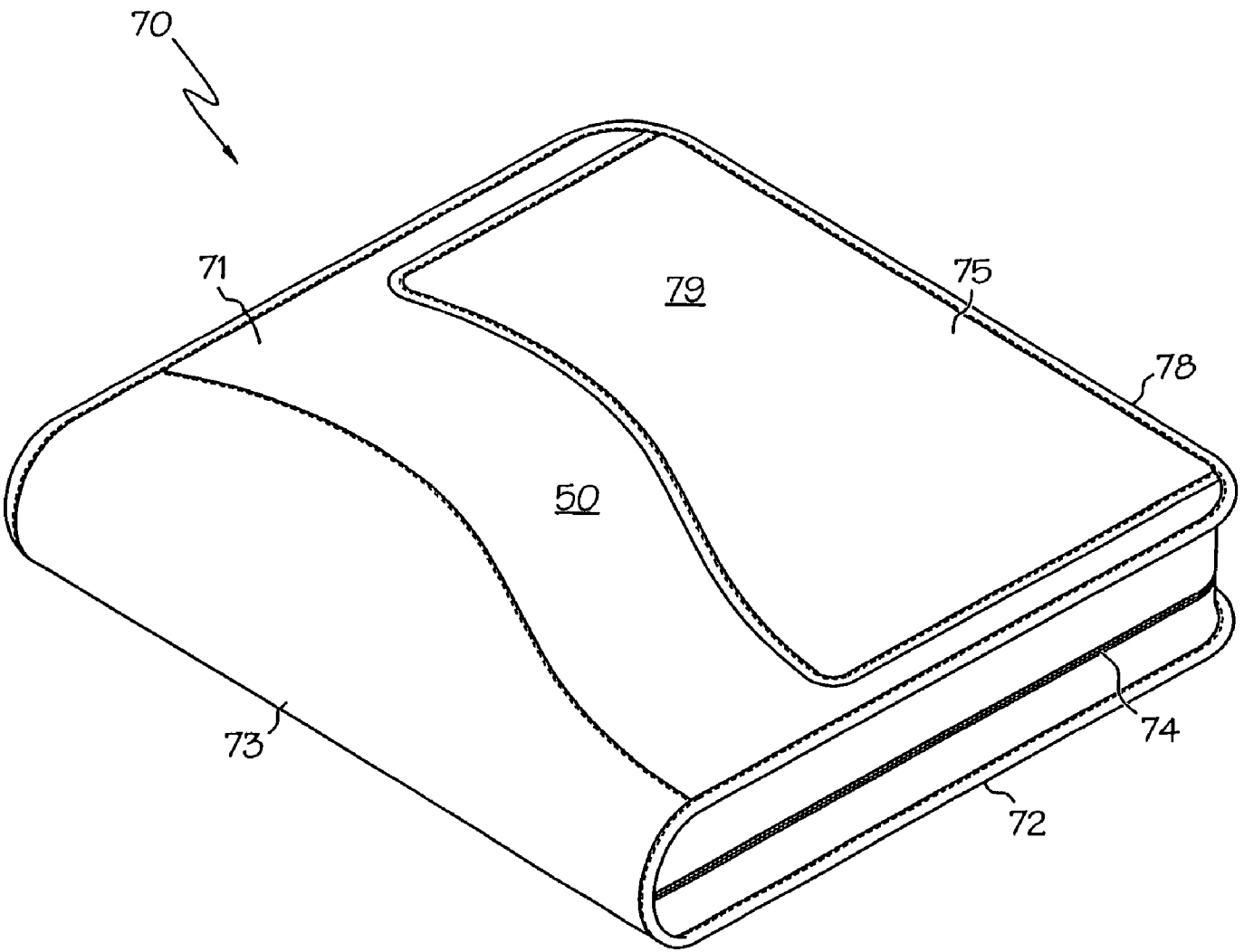
FIG. 5 is a front perspective view of a binder including a writing surface and a flap, with the flap in a closed position.
Figure 6:
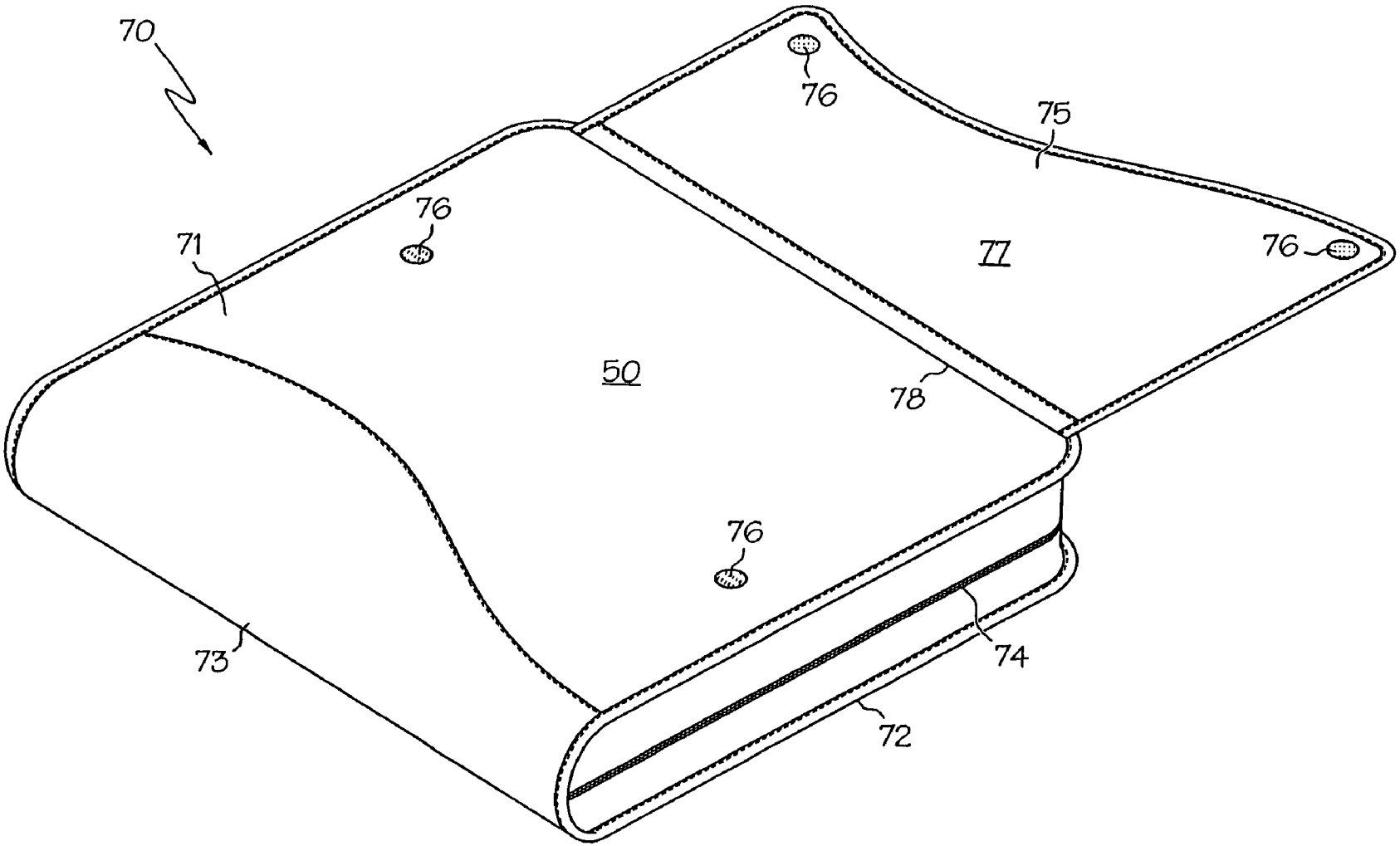
FIG. 6 is a front perspective view of the binder of FIG. 5 with the flap in an open position.

As shown in FIGS. 5 and 6, in one embodiment the binder 70 includes a front cover 71, a back cover 72 and a spine portion 73. The front cover 71 and back cover 72 are pivotally coupled to the spine portion 73. The binder 70 includes a zipper closure mechanism 74 that couples the front cover 71 and back cover 72 together. The binder 70 also includes a flap 75 (having inner surface 77 and outer surface 79) pivotally coupled to the front cover 71 and cooperating securing devices 76 located on the front cover 71 and on the inner surface 77 of the flap 75.

The writing surface 50 is formed on or as part of the front cover 71 (as shown in FIGS. 5 and 6) and/or the back cover 72 (not shown). The flap 75 is hingedly connected to an outer edge 78 of the front cover 71 and pivots from an open position, wherein the flap 75 is spaced or pivoted away from the front cover 71 (see FIG. 6) to a closed position, wherein the flap 75 lies over the front cover 71 (see FIG. 5) to cover all or a portion (anywhere from about 10% to about 100%) of the writing surface 50 on the front cover 71.

When the flap 75 is in the closed position the flap 75 protects the writing surface 50. The securing devices 76 may be positioned on the facing surfaces (i.e., inner surface 77 of flap 75 and surface 50 of front cover 71) to secure the flap 75 in its closed position. The securing devices 76 may take a variety of forms, such as hook-and-loop fasteners (i.e., VELCRO®), magnets, tacky or adhesive material, clips, snaps, or the like. The flap 75 (i.e., including inner surface 77 and outer surface 79) and/or spine portion 73 may also be made of or include a writing surface 50 (not shown).

Figure 7:
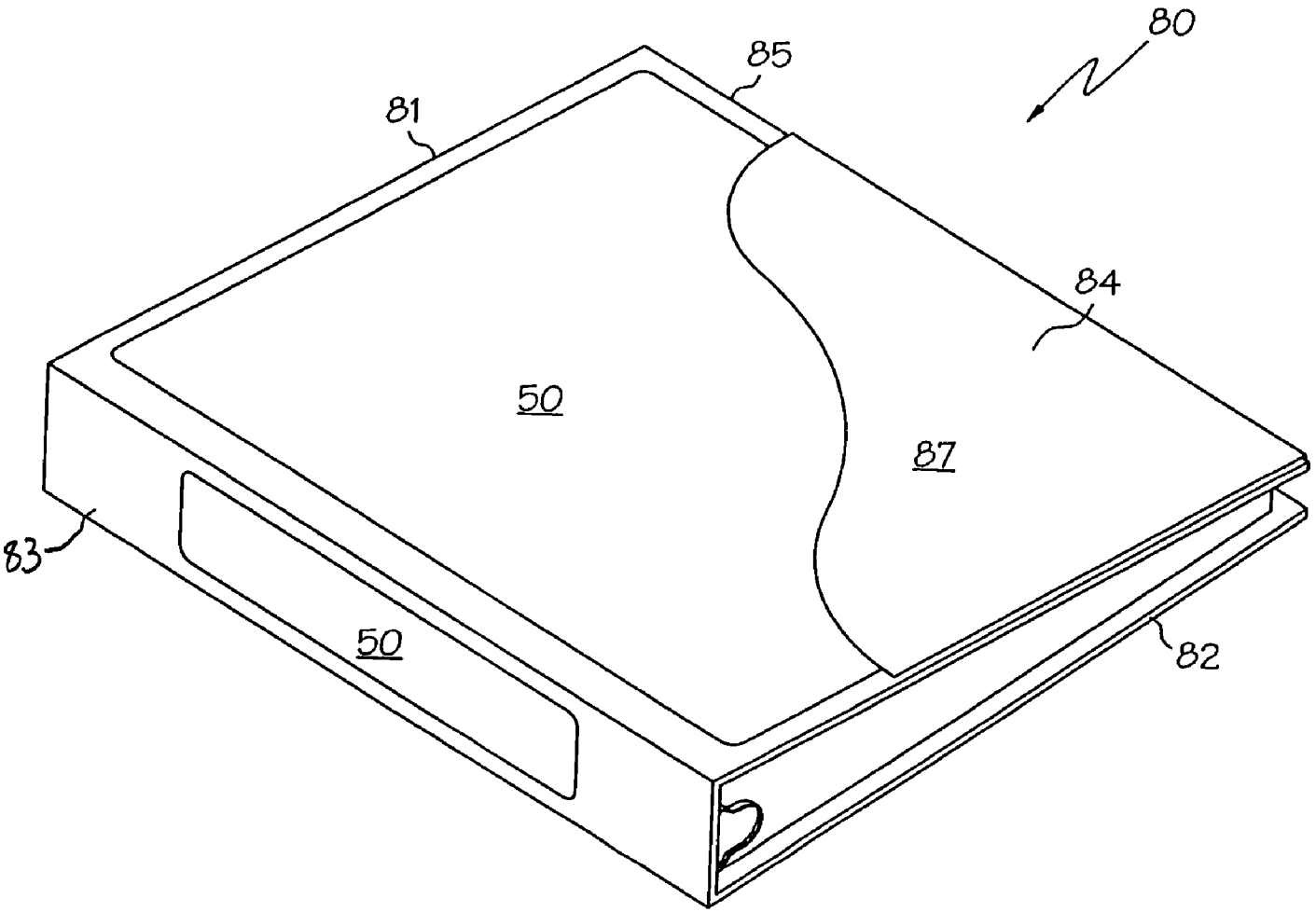
FIG. 7 is a front perspective view of a three-ring notebook including a writing surface and a flap, with the flap in a closed position.
Figure 8:
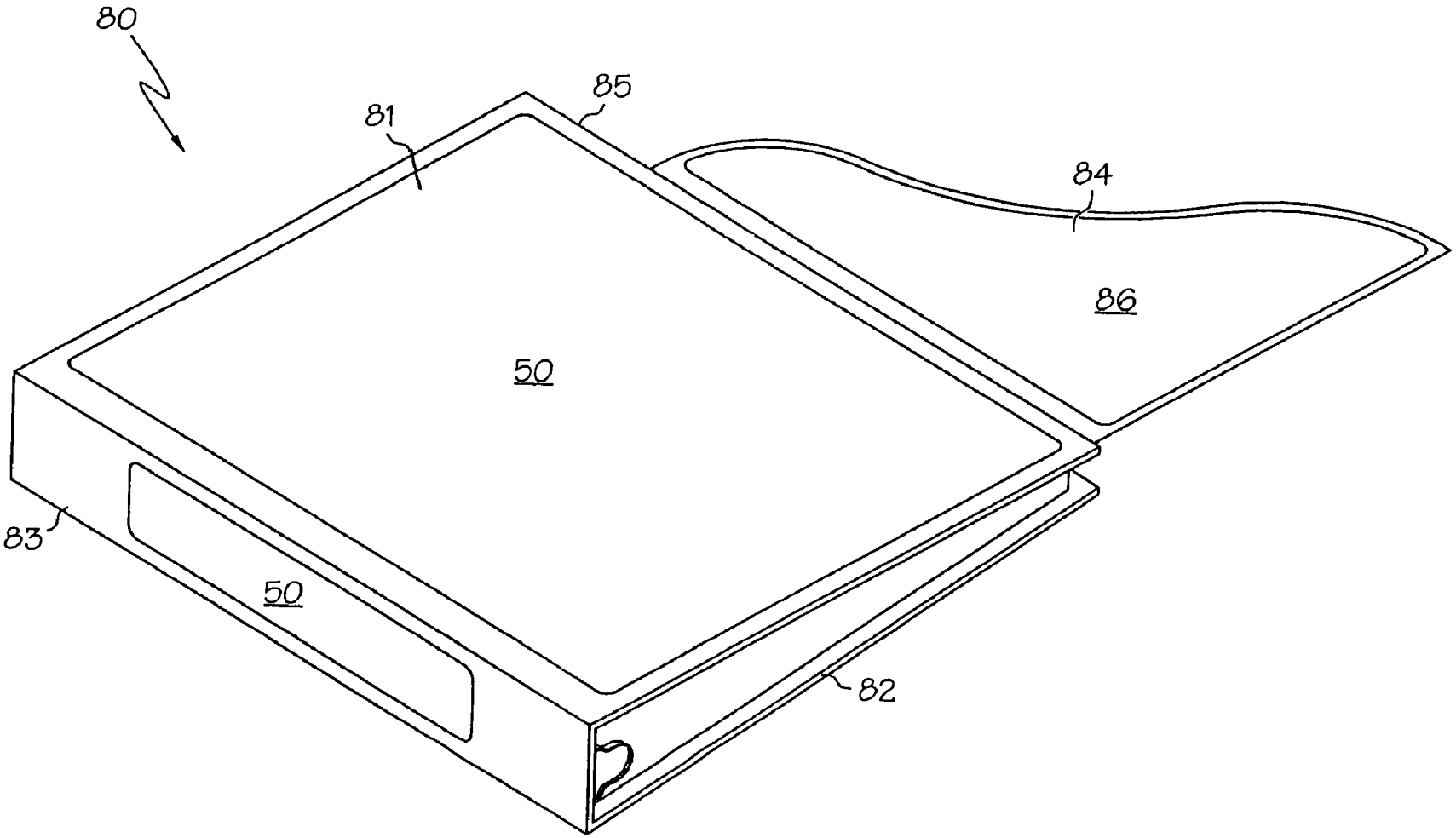
FIG. 8 is a front perspective view of the three-ring notebook of FIG. 7 with the flap in an open position.

As shown in FIGS. 7 and 8, in a second embodiment a three-ring binder 80 includes a front cover 81, a back cover 82 and a spine 83. The front cover 81 and back cover 82 are pivotally coupled to the spine 83. The binder 80 includes a flap 84 (having inner surface 86 and outer surface 87) pivotally coupled to the front cover 81 along edge 85.

The writing surface 50 is formed on or as part of the front cover 81 (and/or back cover 82) and the spine 83. The flap 84 is hingedly connected to the outer edge 85 of the front cover 81 and pivots from an open position, wherein the flap 84 is spaced or pivoted away from the front cover 81 (see FIG. 8) to a closed position, wherein the flap 84 lies over the front cover 81 (see FIG. 7) to cover all or a portion of the writing surface 50 on the front cover 81. The flap 84 may be secured to the front cover 81 (when in the closed position) by various means (not shown), such as hook-and-loop fasteners, magnets, clips, snaps, adhesive or tacky material or the like. In an alternative embodiment, the flap 84 also includes a writing surface 50 (not shown) located on either or both sides thereof.

Figure 9:
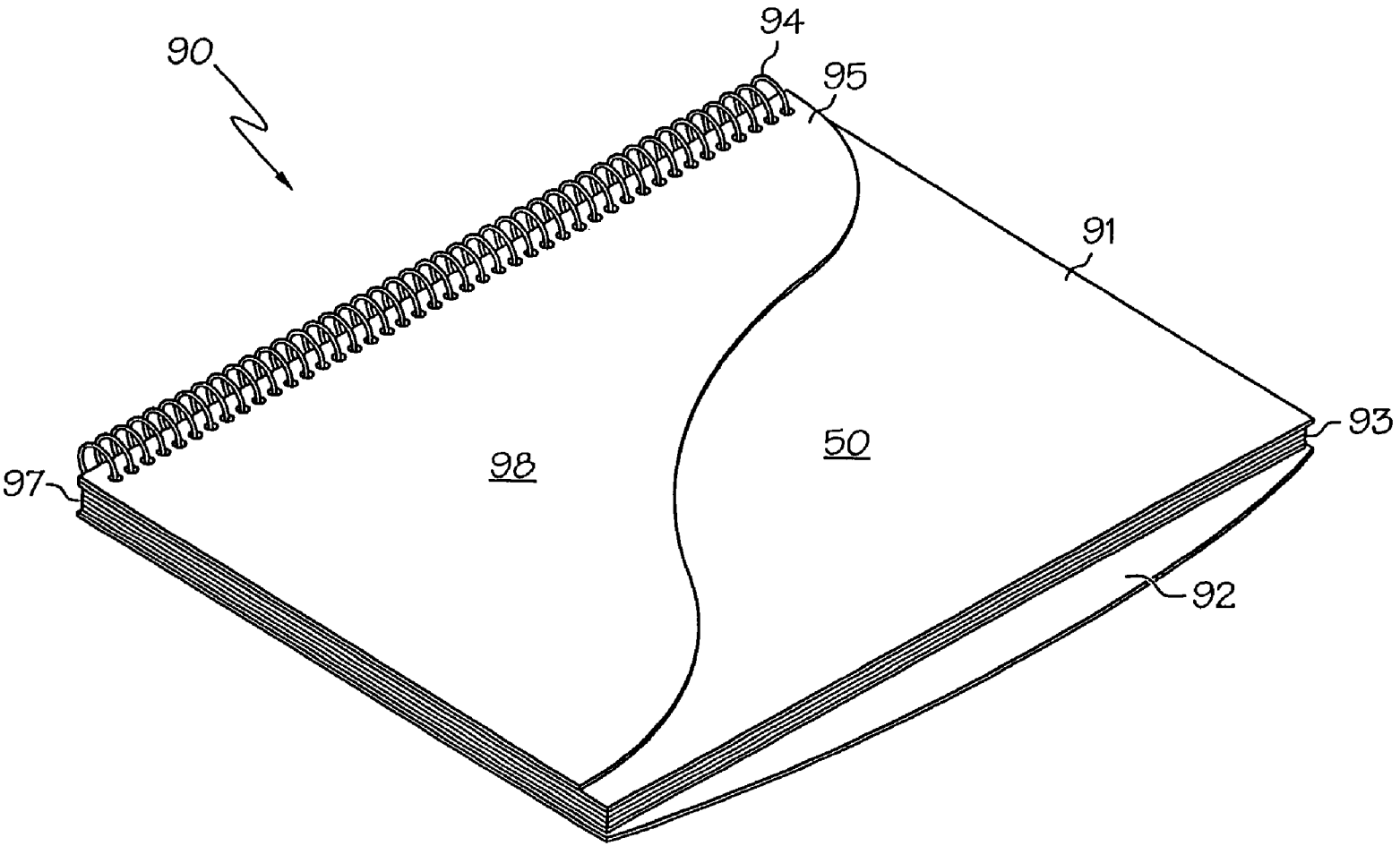
FIG. 9 is a front perspective view of a coil-bound notebook including a writing surface and a flap, with the flap in a closed position.
Figure 10:
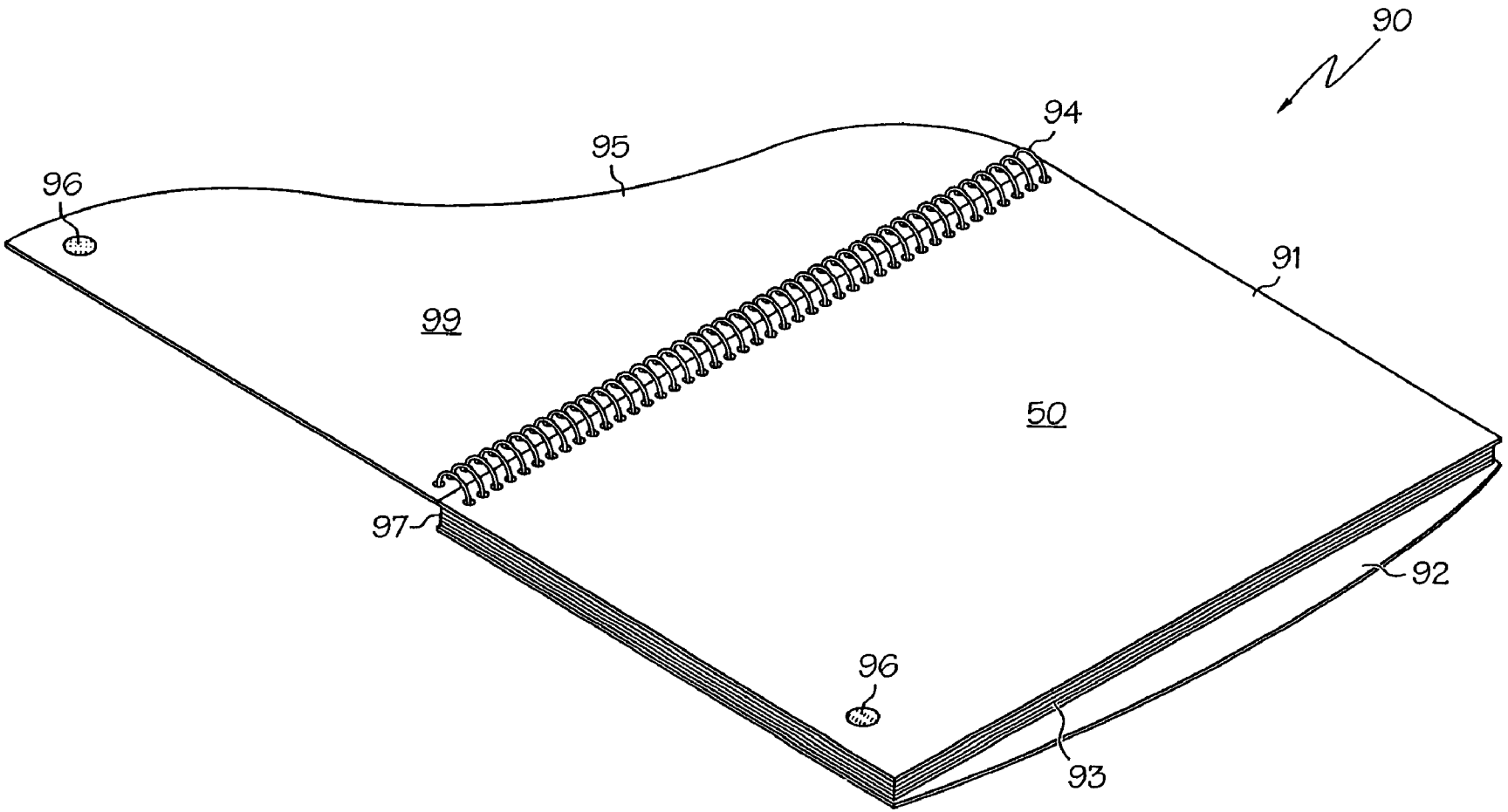
FIG. 10 is a front perspective view of the coil-bound notebook of FIG. 9 with the flap in an open position.

As shown in FIGS. 9 and 10, in a third embodiment a coil bound notebook 90 includes a front cover 91, a back cover 92, a plurality of sheets of paper 93, a coil binding mechanism 94, a flap 95 (having front surface 98 and back surface 99) and cooperating securing devices 96. The sheets of paper 93 are positioned between the front and back covers 91, 92. The flap 95, front and back covers 91, 92 and plurality of sheets of paper 93 are bound together along their binding edges 97 by coil binding 94.

In the illustrated embodiment, the writing surface 50 is formed on or as part of the front cover 91 and/or the back cover 92. Also, the front 98 (see FIG. 9) and/or back 99 surface of the flap 95 may include a writing surface 50. The flap 95 is pivotable about the coil binding mechanism 94 from an open position, wherein the flap 95 is spaced or pivoted away from the front and back covers 91, 92 (see FIG. 10) to a closed position, wherein the flap 95 lies over one of the covers 91, 92 (see FIG. 9) to cover all or a portion of the front or back covers 91, 92. The flap 95 may be secured in the closed position (i.e., to the front or back covers 91, 92) by the securing devices 96 (e.g., hook-and-loop fasteners, magnets, clips, snaps, adhesive or tacky material or the like).

Figure 11:
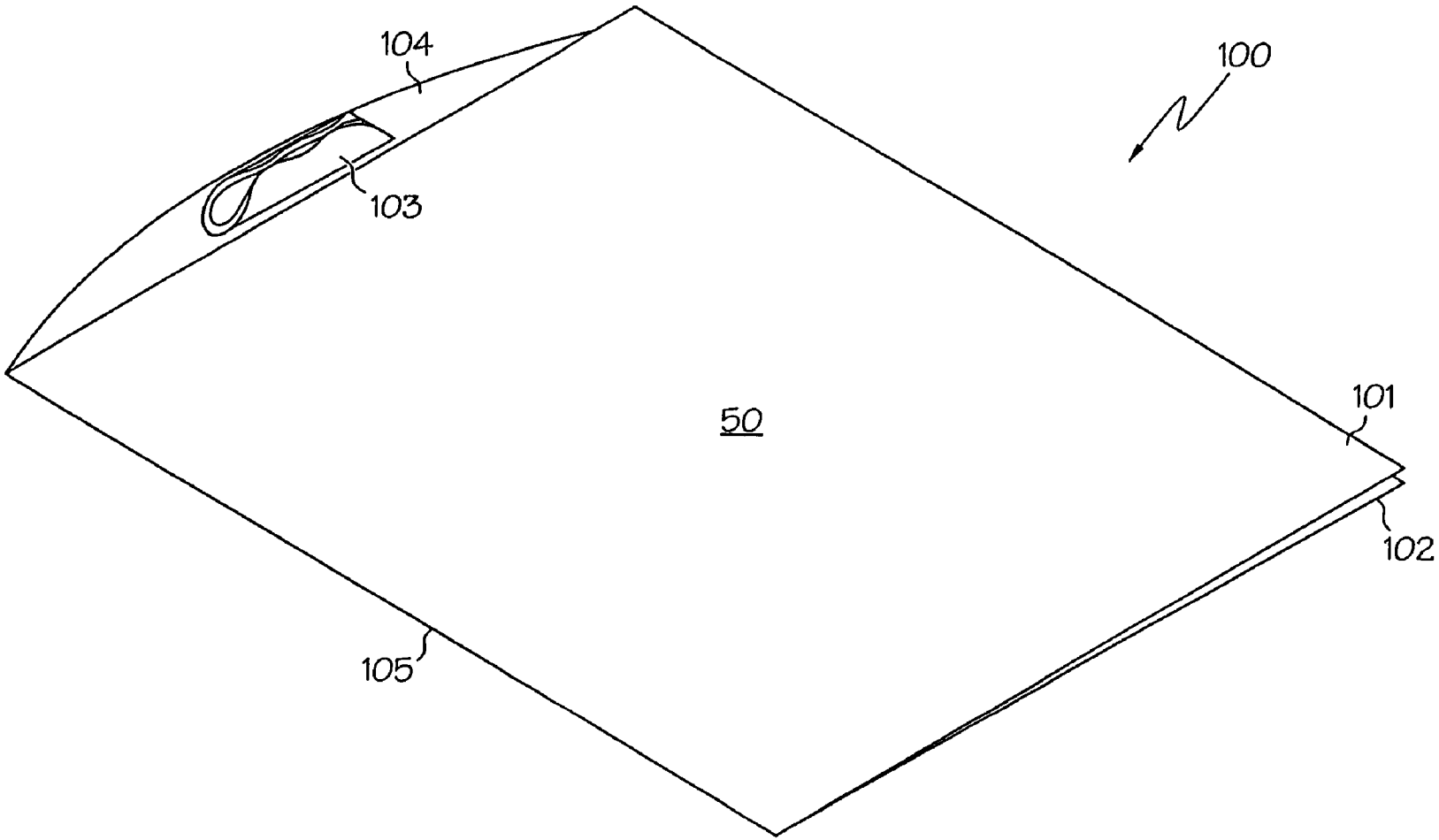
FIG. 11 is a front perspective view of a folder including a writing surface.

As shown in FIG. 11, in a fourth embodiment a folder 100 includes a front cover 101, a back cover 102 and a pen/pencil holder 103. The front cover 101 is pivotally connected to the back cover 102 along a pivot edge 105. The back cover 102 may have a surface area larger than that of the front cover 101 to define a protruding portion 104 that extends upwardly beyond the front cover 101 to provide an area for attaching the pen/pencil holder 103. The entire folder 100 may be constructed from an appropriate material such that the entire folder 100 is made of or forms a writing surface 50. Alternatively, only a portion of the front or back covers 101, 102 may be made of or include the writing surface 50.

Figure 12:
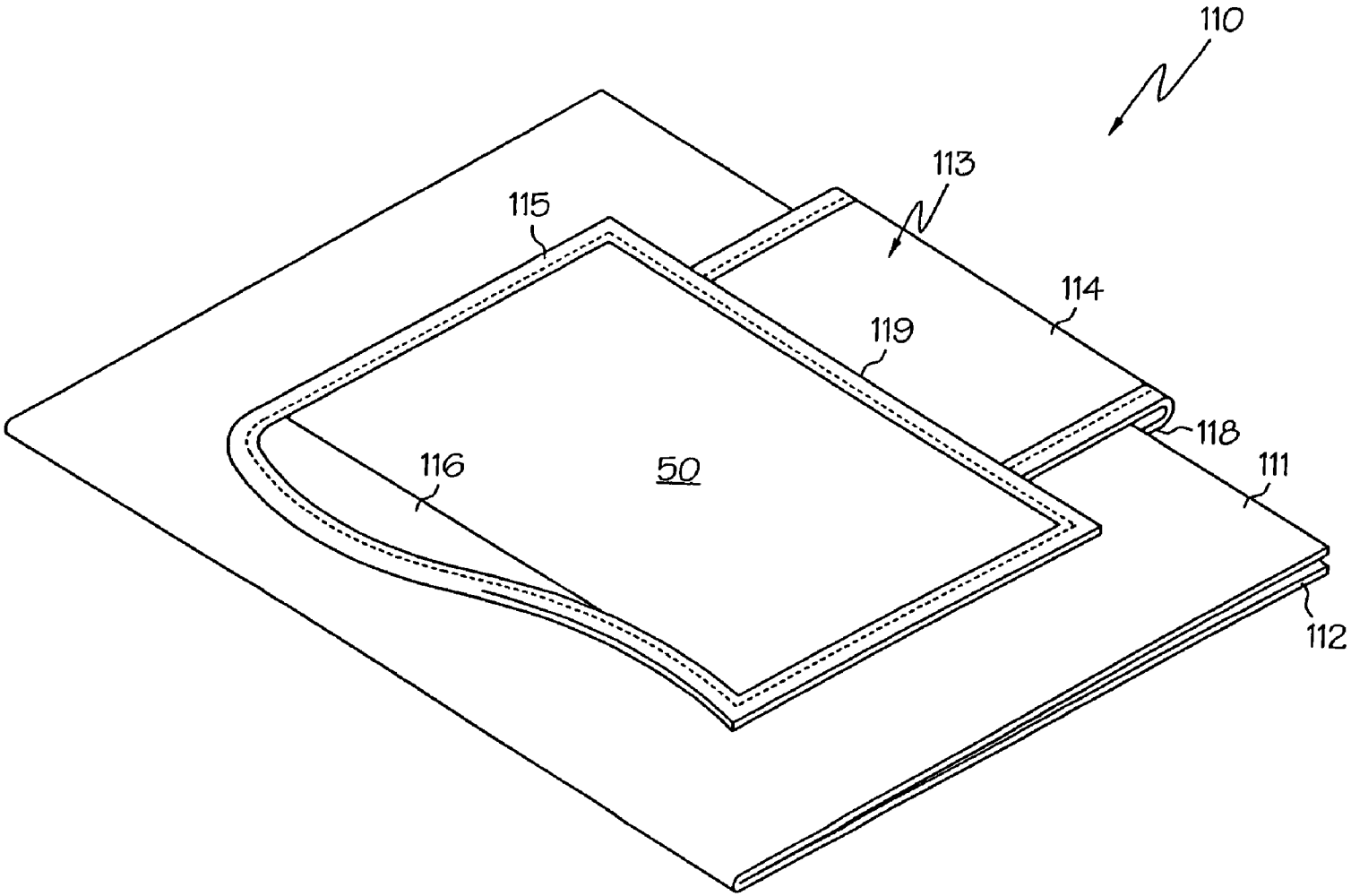
FIG. 12 is a front perspective view of a book cover including a closure mechanism, with the closure mechanism in a closed position.
Figure 13:
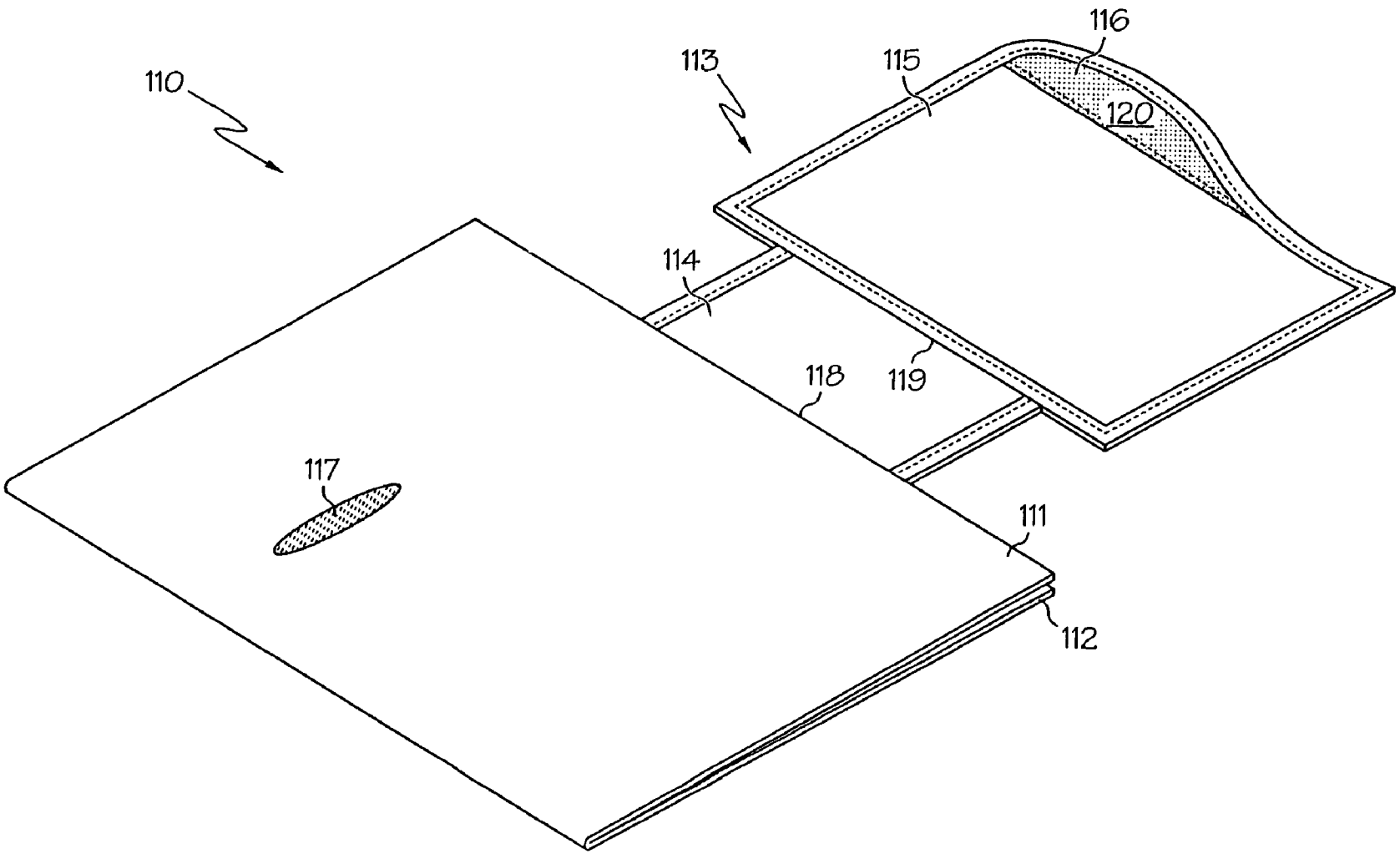
FIG. 13 is a front perspective view of the book cover of FIG. 12 with the closure mechanism in an open position.
Figure 14:
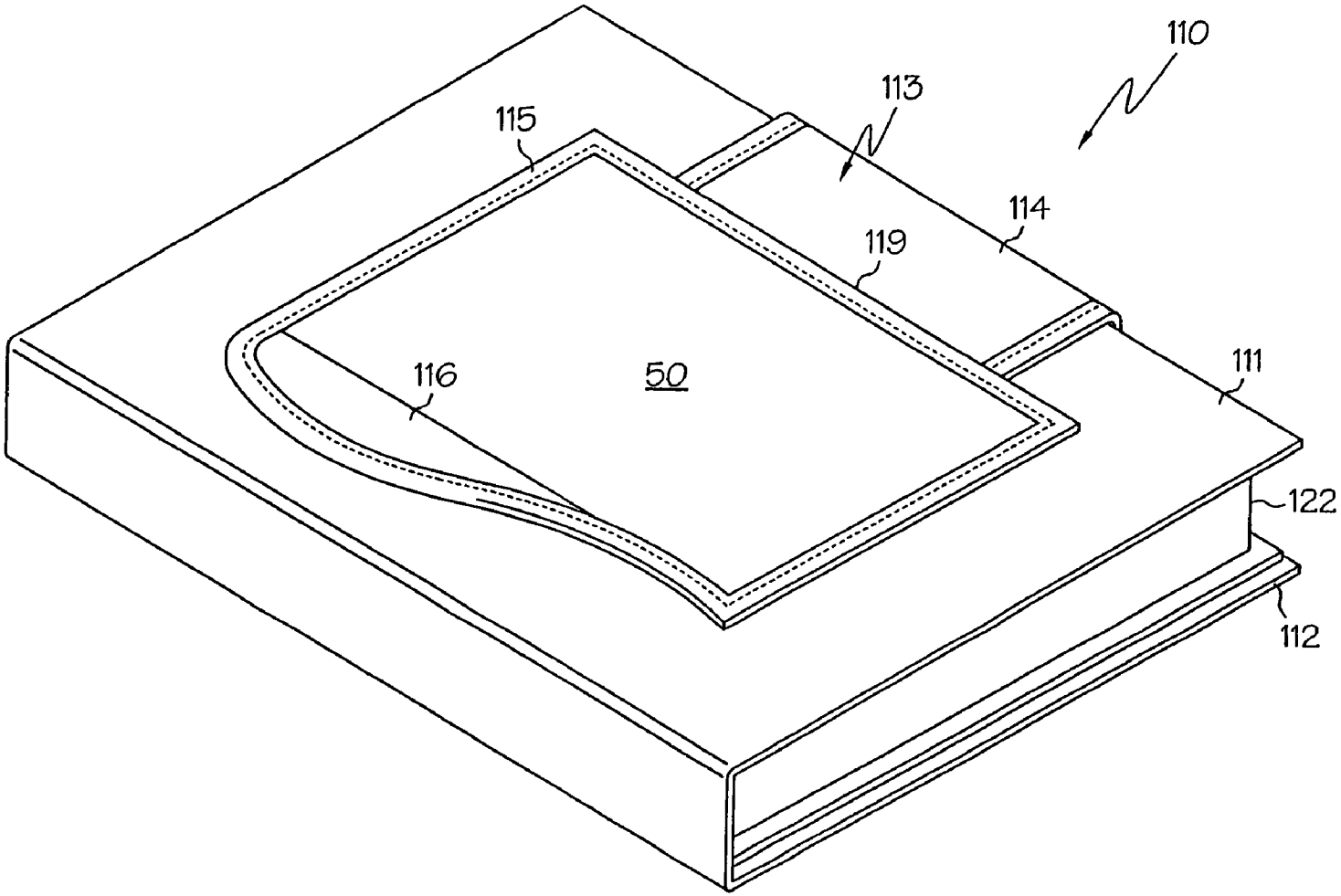
FIG. 14 is a front perspective view of the book cover of FIG. 12 positioned on a book.

As shown in FIGS. 12-14, in a fifth embodiment a book cover 110 includes a front cover portion 111, a back cover portion 112 and a closure mechanism 113. The front and back cover portions 111, 112 are adapted to be received over or around the front and back covers of a book 122 (FIG. 14), respectively, and may be constructed from various materials such as cloth, polymeric-type material, cellulose-based materials such as paper or cardboard, or the like. The closure mechanism 113 includes an elastic portion 114, a writing surface portion 115 having a writing surface 50 and a securing device 116. A first end 118 of the elastic portion 114 is attached to the back cover portion 112 and a second end 119 is connected to the writing surface portion 115.

The securing device 116 includes hook-and-loop fastening material 120 located on the underside of the writing surface portion 115 (see FIG. 13). The hook-and-loop fastening material 120 is configured to engage the corresponding hook-and-loop material 117 affixed to the front cover portion 111 to secure the book cover 110 in the closed position (see FIG. 12). Of course, various other securing devices, as discussed previously, can be used in place of the hook-and-loop fastening material 120.

Rather than being part of a school or office product, the writing surface 50 may simply be a "stand-alone" board such that the writing surface 50 can operate as a bulletin board, and, for example, be coupled to a locker, wall, refrigerator or the like, or be loosely carrier. Thus the writing surface 50 may include magnets, patches of hook-and-loop fastening material (i.e. VELCRO®), hook, snap, clasp, adhesive or other fasteners located on a rear side thereof to aid in attaching the writing surface 50 to various other components. Further, the marker 10 (which may include the cap 40) may be packaged together with the writing surface 50 for sale such that the marker 10 and writing surface 50 are marketed and sold together.

Figure 15:
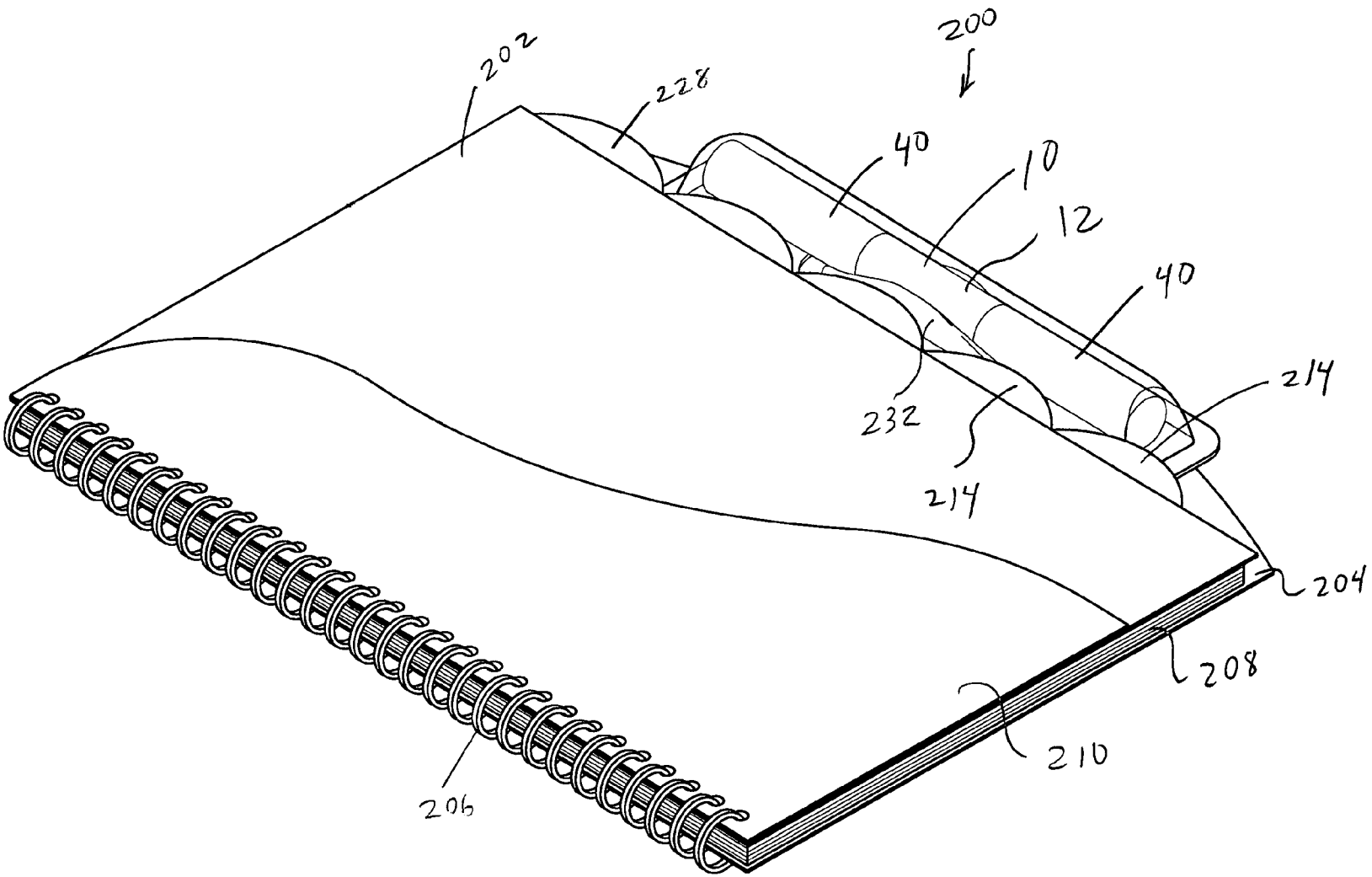
FIG. 15 is a front view of one embodiment of a bound component, shown in its closed position.

As shown in FIG. 15, in one embodiment the present invention may be or include a bound component 200 including a front 202 and rear 204 cover pivotally coupled together. The front 202 and rear 204 covers may be coupled to a binding mechanism 206, such as a twin wire binding mechanism, although the binding mechanism 206 may take a variety of forms, including a single wire binding mechanism, spiral or coil wire binding mechanisms, adhesive binding mechanisms, clips, clasps, 3-ring binding mechanisms, etc.

A plurality of pages 208 may be bound together and to the covers 202, 204 by the binding mechanism 206. Each of the pages 208 may be made of cellulose-based paper or pulpbased paper such that the pages 208 can be written upon by a wide variety of writing instruments, such as pens, pencils, markers and the like. The pages 208 may have various indicia printed thereon, such as calendar or date indicia (for use as a calendar or planner), address and phone information (for use as an address book), ruled lines (for use as a notebook, journal or the like). Of course, various other indicia may be printed on the pages 208, or if desired, the pages may not include any indicia pre-printed thereon.

Figure 16:
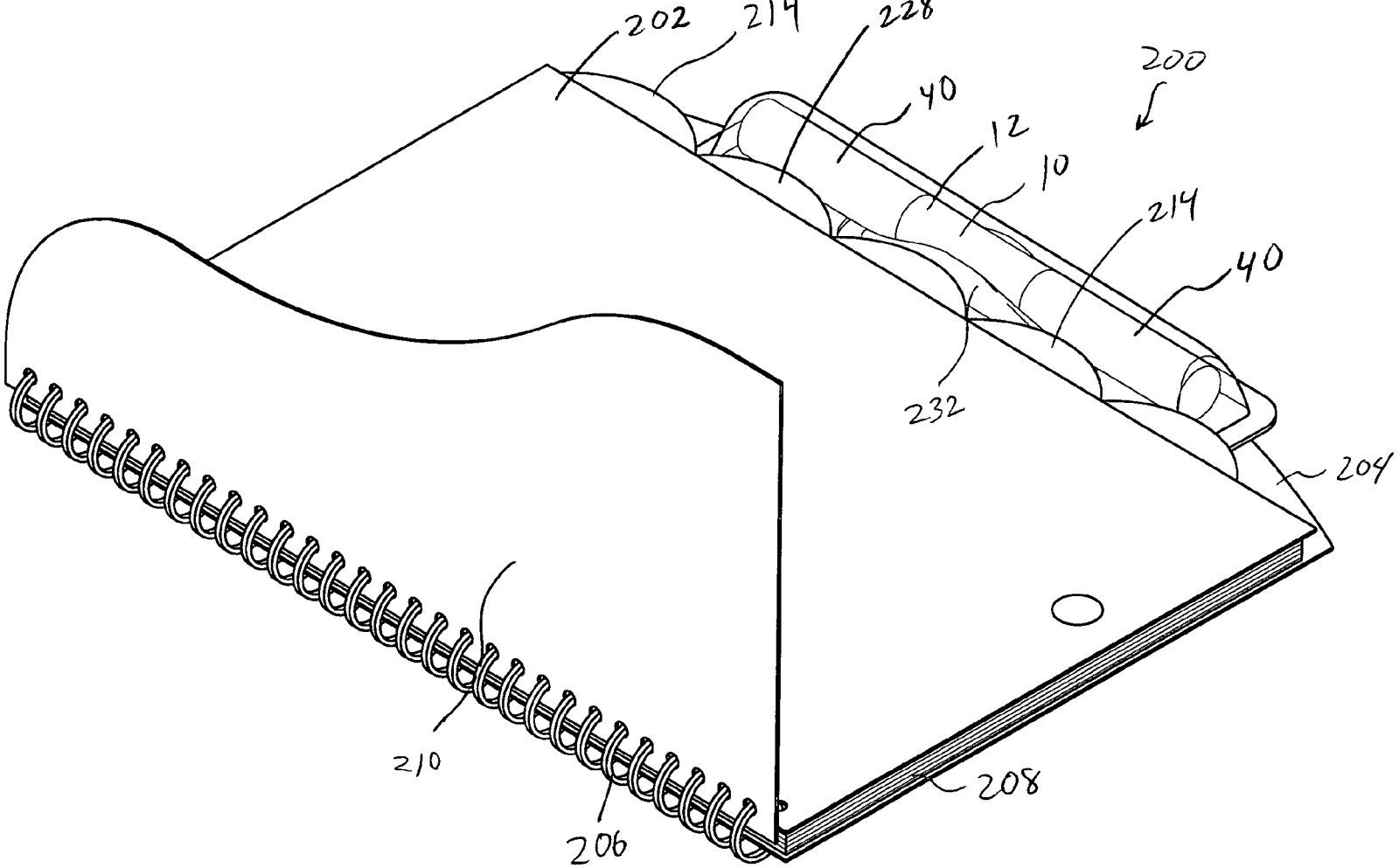
FIG. 16 is a front perspective view of the bound component of FIG. 15, with the cover flap pivoted away from the front cover.

As best shown in FIGS. 15 and 16, the bound component 200 may include a cover panel 210 coupled to the binding mechanism 206 and movable to a position wherein the cover panel 210 covers at least part of the surface area of the front cover 202. Each of the front cover 202, rear cover 204 and cover panel 210 may be made of or include the same material as the material of the writing surface 50 described above for use with the writing instrument 10 described above.

Figure 17:
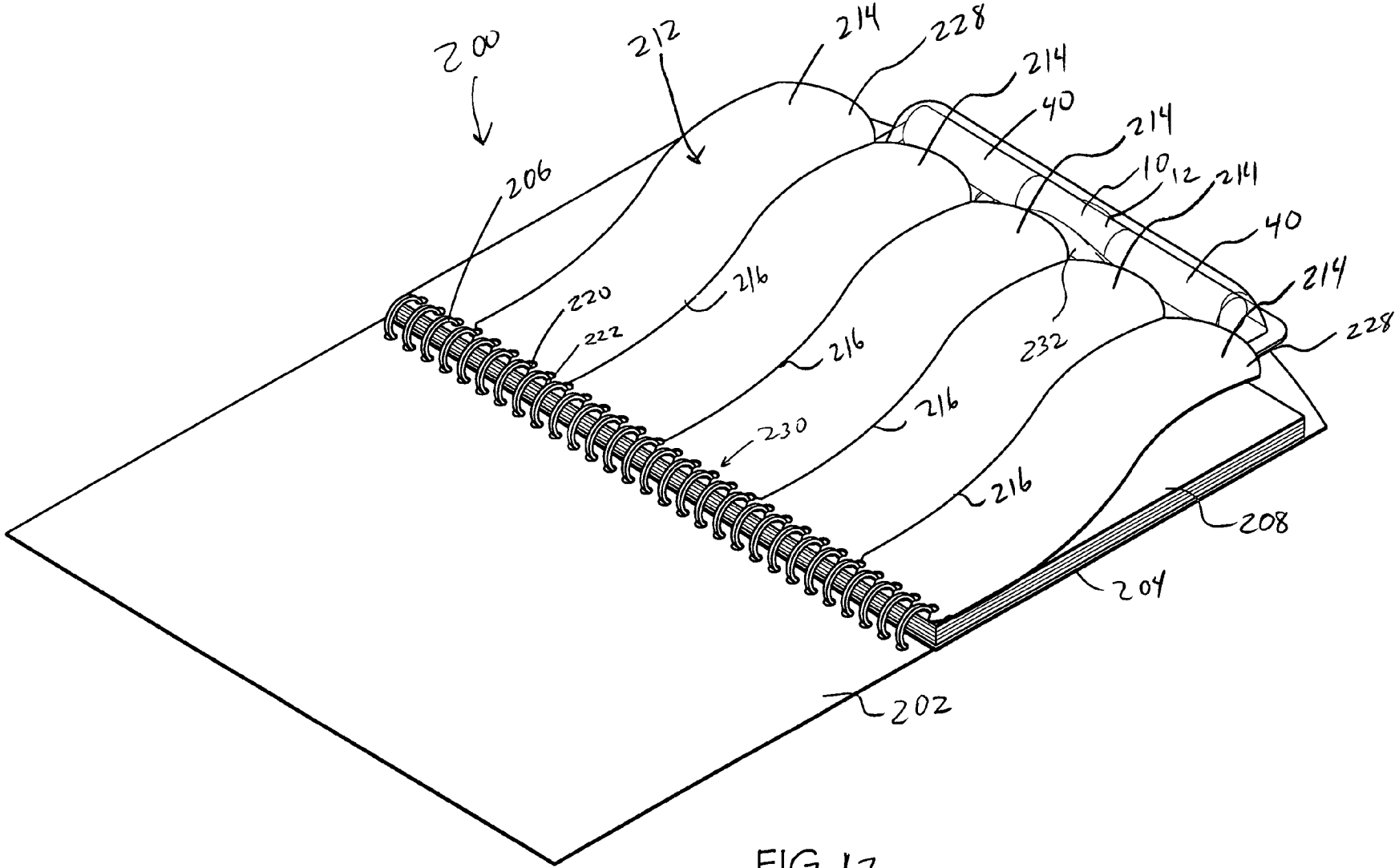
FIG. 17 is a front perspective view of the bound component of FIG. 15, moved to an open position and illustrating a sheet of dividers.
Figure 18:
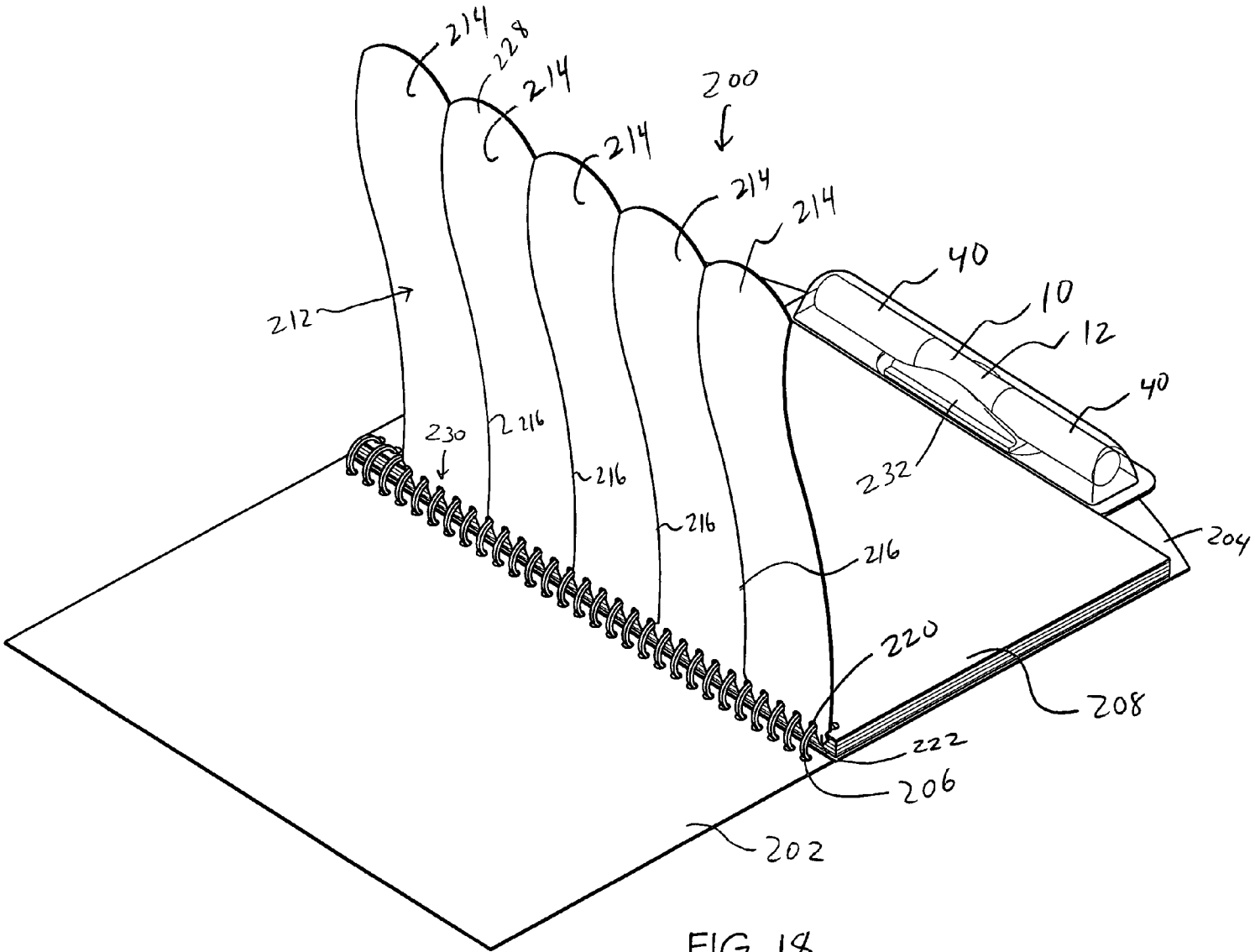
FIG. 18 is a front perspective view of the bound component of FIG. 17, illustrating the sheet of dividers pivoted about the binding mechanism.

As shown in FIGS. 17 and 18, a sheet of dividers 212 may be removably coupled to the binding mechanism 206. In particular, in the illustrated embodiment, five dividers 214 are releasably coupled together along their adjacent longitudinal edges 216 to form the sheet 212. In the embodiment shown in FIGS. 17 and 18, the adjacent longitudinal edges 216 may take the form of score lines, score-slit lines, perforation lines, areas of weakness or the like to allow each divider 214 to be manually torn or separated from the sheet of dividers 212 along its attached longitudinal edge(s) 216. As shown in FIGS. 17 and 18, each of the dividers 214 in the sheet of dividers 212 may be generally nested with no openings therebetween to make efficient use of the available space. In addition, each of the longitudinal edges 216 of the dividers may be generally curved, although the longitudinal edges can be straight, angled and the like as desired.

The sheet of dividers 212, and each individual divider 214, can include or be made of material described above as or for use with the writing surface 50 described above. Thus, each divider 214, as well as the front cover 202, rear cover 204, and covering panel 210, can each be made of a polymer material, and more particularly, polypropylene or polyethylene. Each divider 214, as well as the front cover 202, rear cover 204 and cover panel 210 may be made of material which is chemically resistant (i.e., resists damage or is generally chemically inert) to solvent of the marking instrument 10. Each divider 214, as well as the front cover 202, rear cover 204, and covering panel 210 may have an average surface roughness of between about 50 and about 1000 microns.

Each divider 214 may be made of a generally translucent material to allow any text, drawings or other indicia to be viewable through the divider 214. In addition, each divider 214 may have a sufficient thickness and/or stiffness to allow the divider 214 to maintain a generally flat shape when the divider 214 is held horizontally at only one end thereof (i.e., held in a cantilevered fashion). In other words, each divider 214 may have sufficient rigidity such as to generally maintain a flat, planar shape when oriented horizontally and supported at only one end thereof. More particularly, each divider 214 may have a thickness of at least about 0.5 mm, or at least about 1 mm.

Figure 20:
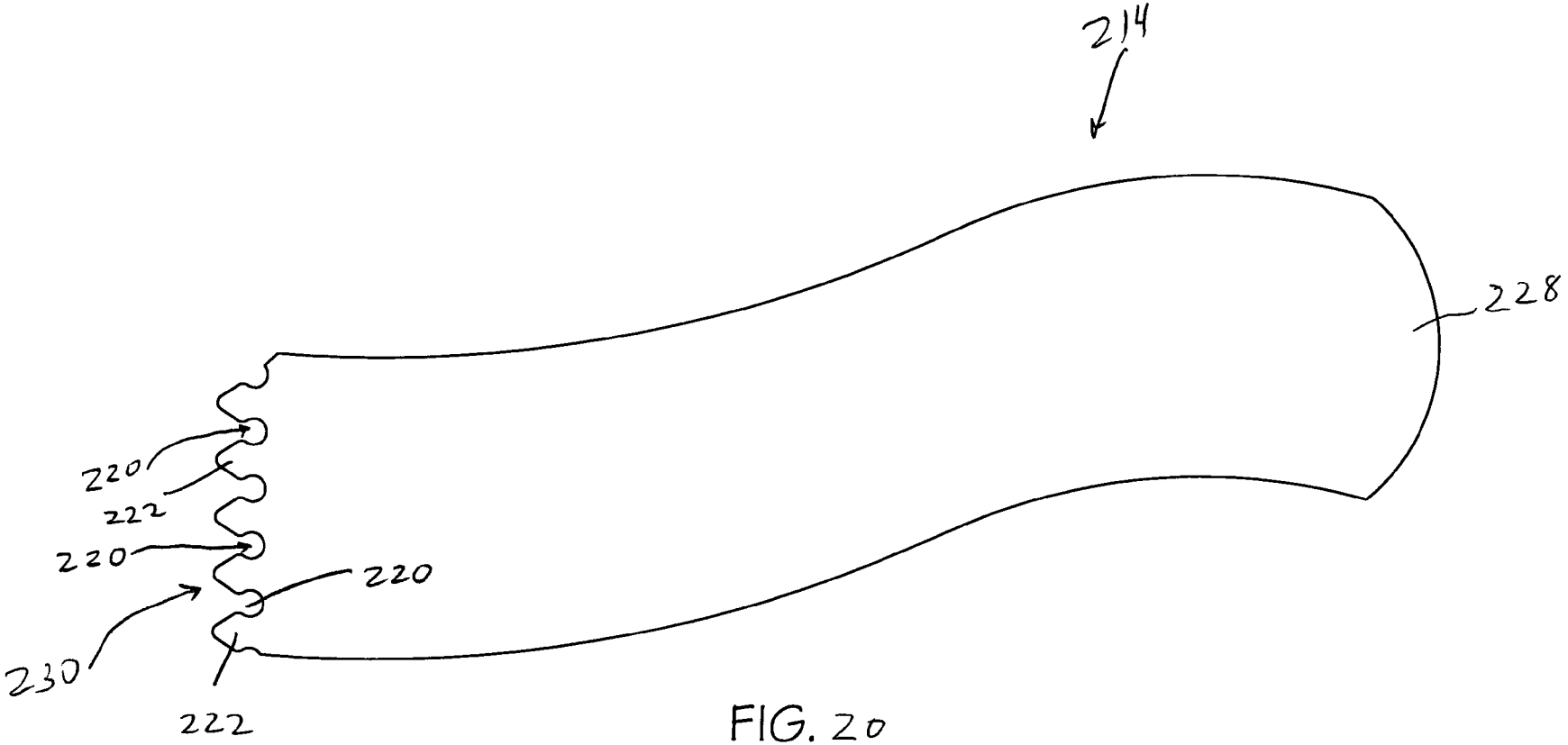
FIG. 20 is a top view of a divider of the divider sheet of FIG. 17.

Each divider 214 may be configured to be directly releasably coupled to the binding mechanism 206. For example, as shown in FIG. 20, each divider 214 may include a plurality of openings 220, with each opening 220 being configured to receive at least one turn of a coil wire or spiral wire binding mechanism 206. Each opening 220 may be located between a pair of adjacent generally arrow-tip shaped or barbed protrusions 222. The angled tips of the protrusions 222 help to guide the wires/turns of the binding mechanism 206 into the openings 220 and retain them therein.

Figure 19:
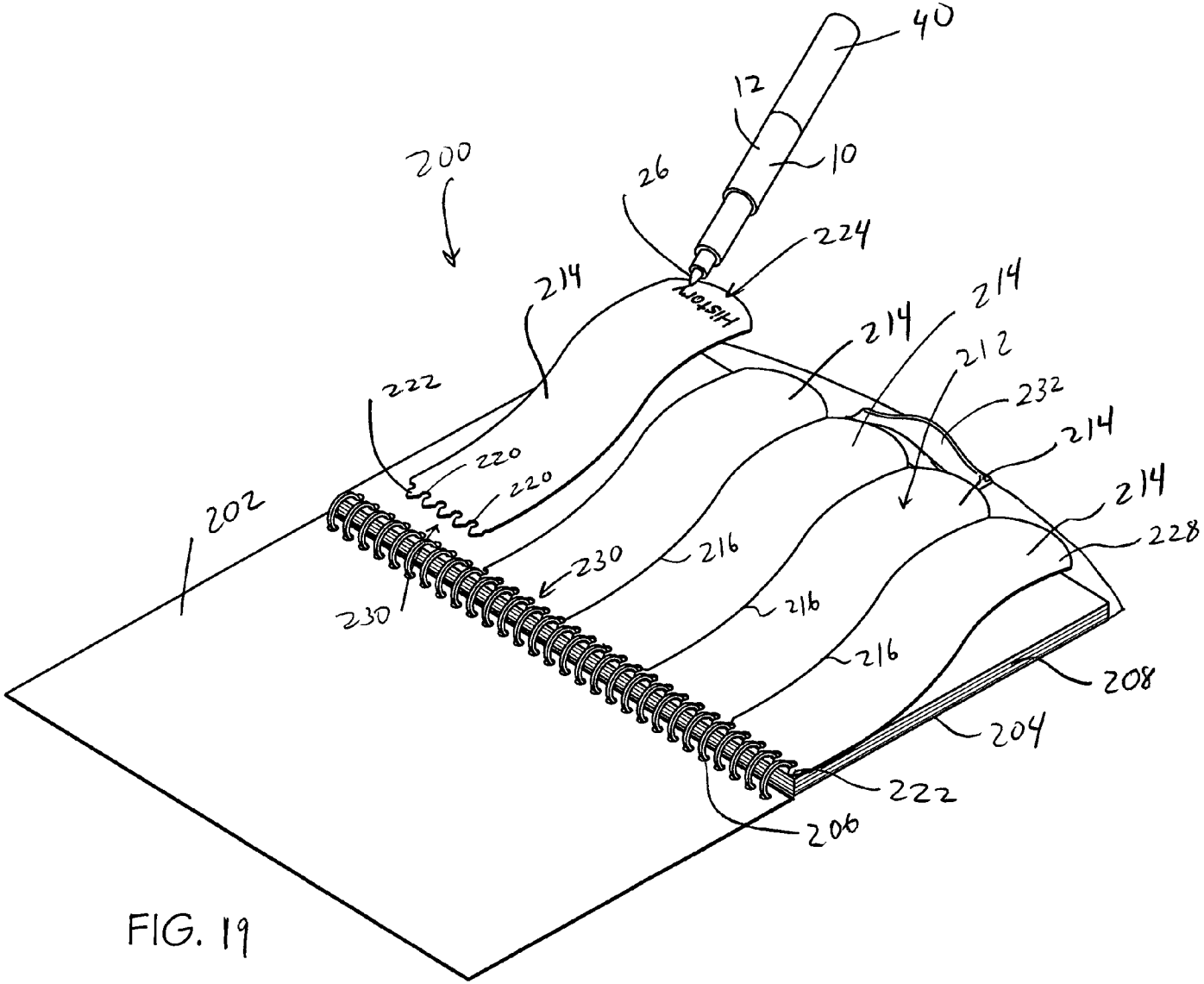
FIG. 19 is a front perspective view of the bound component of FIG. 17, illustrating a single divider broken away, with text being written thereon.

As shown in FIG. 19, in order to utilize a divider 214, the divider 214 is separated from the sheet of dividers 212 by manually separating the divider 214 along its connected longitudinal edge 216. The divider 214 is also separated from the binding mechanism 206 by manually pulling the divider 216 away from the binding mechanism 206 to pull the turns of the binding mechanism 206 out of the openings 220.

Figure 21:
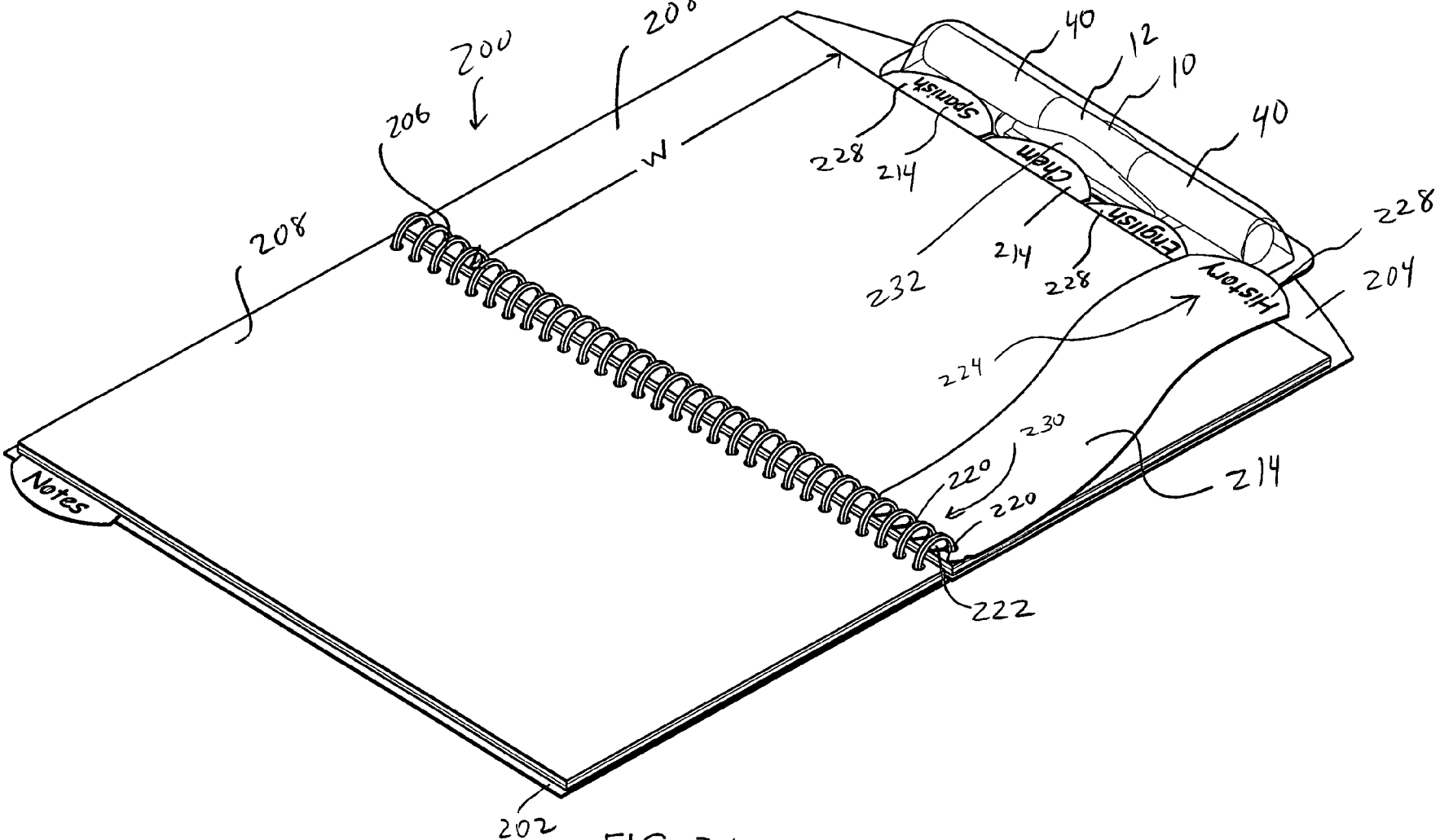
FIG. 21 is a front perspective view of the bound component of FIG. 17, with the divider of FIG. 19 being inserted into the bound component at a thickness location thereof.

A user can write indicia 224 on the divider with the writing tip 26 of the writing instrument 10, as shown in FIG. 19. The indicia 224 can be written when the divider 214 is coupled to the binding mechanism 206, or after the divider 214 is separated from the binding mechanism 206. Next, as shown in FIG. 21, the user turns the pages 208 of the bound component 200 until the desired location of the divider 214 (i.e., in a thickness direction of the bound component 200) is found. The divider 214 is then coupled to the binding mechanism 206 by pressing the turns of the binding mechanism 206 into the openings 220 of the divider 214. The divider 214 is then securely coupled to the binding mechanism 206 such that the divider 214 cannot be easily removed by inadvertent forces.

As shown in FIG. 21, each of the sheets of paper 208 may have a width dimension w extending generally perpendicular to the binding mechanism 206. Each divider 214 may also include a width dimension extending generally perpendicular to the binding mechanism 206, wherein the width of each divider 214 is greater than the width w of the plurality of sheets of paper 208. In this manner, the divider 214 includes a protruding portion 228 which protrudes outwardly from the pages 208 to allow the protruding portion 228 to be easily viewed, even when the bound component 10 is closed.

The protruding portion 228 may have a width of less than about 1 inch or less than about ½ of an inch, but more than about ¼ inch to allow sufficient surface area for writing thereon but so as to not protrude too far outwardly which could add additional width to the bound component 200 and which could prevent the bound component 200 from being easily handled. In addition, the protruding portion 228 of each divider 214, along with the thickness/stiffness of each divider 214, may allow each divider 214 to be pivoted about the binding mechanism 206 and carry a plurality of bound pages 208 with the divider 214 as the divider 214 is pivoted (i.e., each divider 214 can function as a place-holder or page-turner).

Thus, when writing indicia 224 on the divider 214 (i.e., as shown in FIG. 19), it may be desired to write on the protruding portion 228 of the divider 214. However, the remainder of the body of the divider 214 is also available for writing thereon should more extensive notes, reminders etc. be desired to be written thereon, or should such indicia be desired to be hidden from view. In addition, the user may be able to write on both sides of the divider 214.

Figure 22:
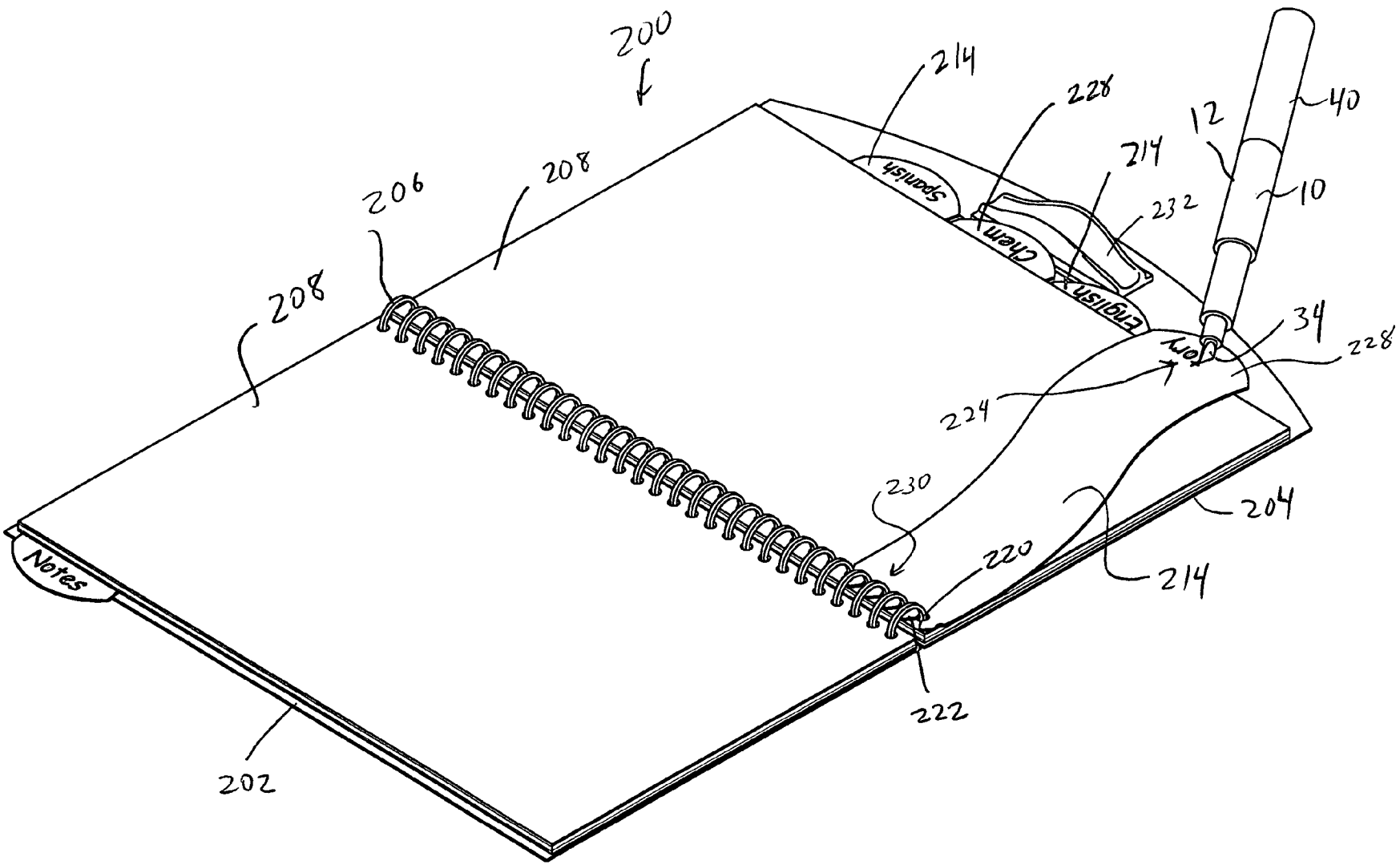
FIG. 22 is a front perspective view of the bound component of FIG. 20, with the text written on the divider being erased.
Figure 23:
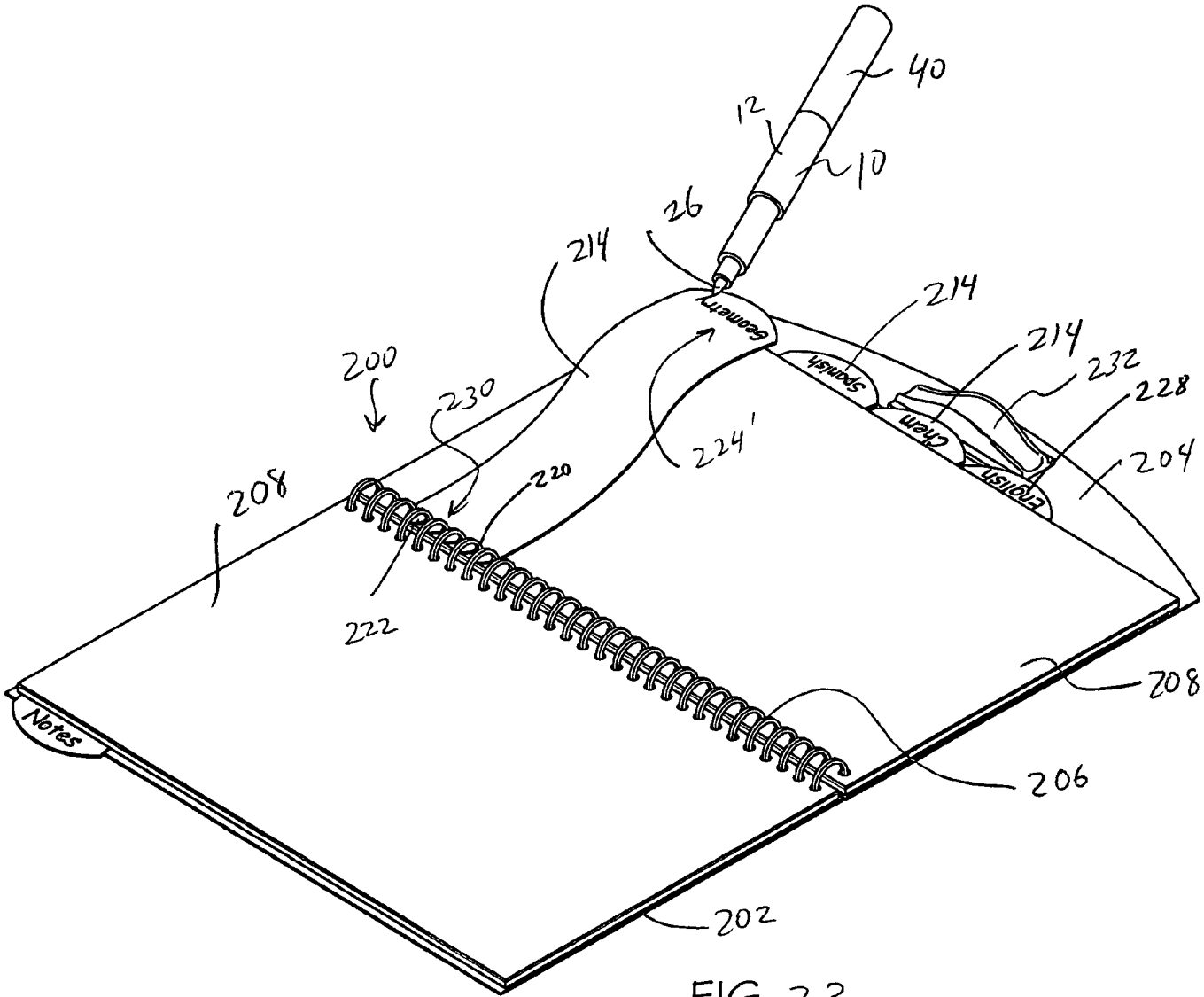
FIG. 23 is a front perspective view of the bound component of FIG. 20, with the divider being moved to a different location along the length of the binding component.

Each divider 214 may have a coupling edge or portion 230 which is configured to be coupled to the binding mechanism 206 (i.e., the coupling edge 230 may have the openings 220/protrusions 222 formed therealong). Each coupling edge 230 may have a length that is less than the length of the binding mechanism 206. More particularly, the coupling edge 230 may have a length that is less than about ¼ of the length of the binding mechanism 206, or less than about ⅕ of the length of the binding mechanism 206. This configuration allows a plurality of dividers 214 to be coupled at a single thickness location of the bound component 200 and allows the sheet of dividers 212 to be provided. This configuration also allows a tiered arrangement of dividers to be provided, as shown in FIGS. 21-23.

The dividers 214 are able to be repositioned at various locations of the thickness of the bound component 210, to be positioned at various locations along the length of the binding mechanism 206, and to be rewritten thereon which allows great flexibility in the use and reuse of the dividers. For example, the divider 214 fully shown in FIG. 21 may be desired to be repositioned and/or reused. If a student user should complete a history course, and in its place begin a geometry course, the divider 214 shown in FIG. 21 can be easily repositioned and reused. As shown in FIG. 22, the erasing tip 34 of the marking instrument 10 can be used to erase the "History" text 224 written on the divider 214. The divider 214 can then be uncoupled from the binding mechanism 206 and moved to a different position along the length of the binding mechanism 206 (FIG. 23). New text 224' (i.e., "Geometry" in the illustrated embodiment) can then be written on the divider 214. Of course, if desired, the divider 214 can be positioned at a different location in the thickness of the bound component 200. In this manner, it can be seen that the dividers 214 of the present invention provide great flexibility in reuse, repositioned and relabeling.

The bound component 200 may be configured to releasably receive the writing instrument 10 therein or thereon. In particular, the back cover 204 of the bound component may include a spring clip 232 which can releasably receive the writing instrument 10 therein. In this manner, the bound component 200 may be able to carry the writing instrument 10, including the writing tip 26, erasing tip 34 and/or absorbent portion 32, with the bound component 200 for easy and convenient use and storage. Of course, the writing instrument 10 may be able to be coupled to various other locations of the notebook 200, including the front cover 202, pages 208, binding mechanism 206, dividers 214, etc.

Having described the invention in detail and by reference to the various embodiments, it will be apparent that modifications and variations thereof are possible without departing from the scope of the invention.

What is claimed is:

1. A system comprising:

a bound component comprising a plurality of sheets of paper and a binding mechanism binding said plurality of sheets of paper together, wherein said binding mechanism is a coil wire or spiral wire binding mechanism;

a divider sheet configured to be directly releasably coupled to said binding mechanism such that said divider sheet can be positioned between adjacent ones of said sheets of paper;

wherein said divider sheet comprises a plurality of dividers releasably coupled together along their adjacent longitudinal edges so as to be completely separable from one another;

wherein each individual divider after being separated from others of the plurality of dividers is itself configured to be directly releasably coupled to said binding mechanism.

2. The system of claim 1, further comprising a permanent writing instrument configured to dispense permanent markings on said divider sheet when said divider sheet is written upon by said writing instrument; wherein said writing instrument is coupled to said bound component.

3. The system of claim 1, further comprising erasing means for erasing permanent markings from said divider sheet.

4. The system of claim 3 wherein said erasing means is coupled to said writing instrument.

5. The system of claim 2 wherein said permanent writing instrument is configured to dispense a solvent based permanent ink.

6. The system of claim 5 wherein said divider sheet is made of a polymeric material that is chemically resistant to said solvent.

7. The system of claim 2 wherein said permanent markings generally resist removal by soap and water.

8. The system of claim 1 wherein said divider sheet is made of polypropylene or polyethylene.

9. The system of claim 1 wherein said divider sheet has an average surface roughness of between about 50 and about 1000 microns.

10. The system of claim 1 wherein said plurality of sheets have a width dimension extending generally perpendicular to said binding mechanism, and wherein said divider sheet has a width greater than said width of said plurality of sheets of paper such that at least part of said divider sheet protrudes outwardly from said plurality of sheets of paper when said divider sheet is directly coupled to said binding mechanism.

11. The system of claim 1 wherein said divider sheet is made of a generally translucent material.

12. The system of claim 1 wherein said divider sheet includes a plurality of openings along an outer edge thereof, each opening being configured to receive at least one turn of said coil wire or spiral wire binding mechanism therein to directly releasably couple said divider sheet to said binding mechanism.

13. The system of claim 1 wherein said divider sheet has a coupling edge configured to be directly coupled to said binding mechanism, and wherein said coupling edge has a length that is less than a length of said binding mechanism.

14. The system of claim 1, wherein said divider sheet comprises an outer edge with a plurality of generally arrow-tip shaped or barbed protrusions extending from said outer edge.

15. The system of claim 1 further comprising a cover made of a polymer material that is bound to said plurality of sheets by said binding mechanism, and wherein said cover is configured to receive permanent markings thereon from a writing instrument, and wherein said permanent markings on said cover can be erased by an erasing means.

16. A method for using a divider sheet comprising the steps of:

providing a bound component comprising a plurality of sheets of paper and a binding mechanism binding said plurality of sheets of paper together, wherein said binding mechanism is a coil wire or spiral wire binding mechanism;

providing a divider sheet;

releasably coupling said divider sheet directly to said binding mechanism such that said divider sheet is positioned between adjacent ones of said sheets;

wherein said divider sheet comprises a plurality of individual dividers releasably coupled together along their adjacent longitudinal edges so as to be completely separable from one another;

wherein each individual divider after being separated from others of the plurality of dividers is itself configured to be directly releasably coupled to said binding mechanism.

17. The method of claim 16 wherein said plurality of sheets have a width dimension extending generally perpendicular to said binding mechanism, and wherein said divider sheet has a width greater than said width of said plurality of sheets of paper such that said divider sheet has a protruding portion that protrudes outwardly from said plurality of sheets of paper.

18. The method of claim 16 further comprising the step of uncoupling said divider sheet or one of said individual dividers from said binding mechanism, and coupling said divider sheet or individual divider to said binding mechanism at a different thickness location in said bound component such that said divider sheet or individual divider is located between different adjacent ones of said sheets.

19. A bound component system comprising:

a plurality of sheets of paper;

a binding mechanism binding said plurality of sheets of paper together, said binding mechanism being a coil wire or spiral wire binding mechanism, said plurality of sheets of paper having a width dimension extending generally perpendicular to said binding mechanism; and a divider sheet configured to be directly releasably coupled to said binding mechanism such that said divider sheet can be positioned between adjacent ones of said sheets, wherein said divider sheet has a width greater than said width of said plurality of sheets of paper;

wherein said divider sheet comprises a plurality of dividers releasably coupled together along their adjacent longitudinal edges so as to be completely separable from one another;

wherein each individual divider after being separated from others of the plurality of dividers is itself configured to be directly releasably coupled to said binding mechanism.

20. The system of claim 19 wherein said divider sheet has a width greater than said width of said plurality of sheets of paper such that at least part of said divider sheet protrudes outwardly from said plurality of sheets of paper when said divider sheet is directly coupled to said binding mechanism.

21. The system of claim 19 further comprising a permanent writing instrument configured to dispense permanent markings on said divider sheet when said divider sheet is written upon by said writing instrument.

22. The system of claim 21 wherein said permanent writing instrument is coupled to at least one of said sheets of paper, said binding mechanism or said divider sheet.

23. The system of claim 21 wherein said permanent writing instrument is configured to dispense a solvent based permanent ink and wherein said divider sheet is made of a material that is chemically resistant to said solvent.

24. The system of claim 21 further comprising erasing means for erasing said permanent markings from said divider sheet.

25. The system of claim 24 wherein said erasing means is positioned on said writing instrument.

26. The system of claim 21 wherein said permanent markings generally resist removal by soap and water.

27. The system of claim 19 wherein said divider sheet is made of polypropylene or polyethylene.

28. The system of claim 19 wherein said binding mechanism is a coil wire or spiral wire binding mechanism.

29. The system of claim 28 wherein said divider sheet includes a plurality of openings along an outer edge thereof, each opening being configured to receive at least one turn of said coil wire or spiral wire binding mechanism therein to directly releasably couple said divider sheet to said binding mechanism.

30. The system of claim 19 wherein said divider sheet has a width that is less than about ½ inch greater than said width of said plurality of sheets of paper.

31. The system of claim 19 wherein each of said dividers has a coupling edge configured to be directly coupled to said binding mechanism, and wherein said coupling edge has a length that is less than a length of said binding mechanism.

32. The system of claim 31 wherein said length of said coupling edge is less than about ¼ of said length of said binding mechanism.

33. The method of claim 16, wherein said divider sheet comprises an outer edge with a plurality of generally arrow-tip shaped or barbed protrusions extending from said outer edge.

34. The bound component system of claim 19, wherein said divider sheet comprises an outer edge with a plurality of generally arrow-tip shaped or barbed protrusions extending from said outer edge.

* * * * *